US010925806B2

(12) United States Patent
Zhang

(10) Patent No.: US 10,925,806 B2
(45) Date of Patent: Feb. 23, 2021

(54) DEVICE FOR ACUPUNCTURE AND MOXIBUSTION THERAPY AND USES THEREOF

(71) Applicant: Xunhua Zhang, Elmhurst, NY (US)

(72) Inventor: Xunhua Zhang, Elmhurst, NY (US)

( * ) Notice: Subject to any disclaimer, the term of this patent is extended or adjusted under 35 U.S.C. 154(b) by 0 days.

(21) Appl. No.: 17/005,074

(22) Filed: Aug. 27, 2020

(65) Prior Publication Data

US 2020/0390650 A1 Dec. 17, 2020

Related U.S. Application Data

(63) Continuation-in-part of application No. PCT/IB2020/055343, filed on Jun. 6, 2020.
(Continued)

(30) Foreign Application Priority Data

Mar. 26, 2020 (CN) ..... 202010222365.4

(51) Int. Cl.
*A61H 39/00* (2006.01)
*A61H 39/08* (2006.01)
(Continued)

(52) U.S. Cl.
CPC ..... *A61H 39/002* (2013.01); *A61H 39/04* (2013.01); *A61H 39/086* (2013.01);
(Continued)

(58) Field of Classification Search
CPC ..... A61B 17/320068; A61B 17/3423; A61H 23/0245; A61H 23/0236; A61H 39/08;
(Continued)

(56) References Cited

U.S. PATENT DOCUMENTS 4,895,149 A 1/1990 Morez
7,819,826 B2 10/2010 Diederich et al.
(Continued)

FOREIGN PATENT DOCUMENTS

CN 101284163 B 5/2011
CN 102397652 A 4/2012
(Continued)

OTHER PUBLICATIONS

International Search Report, dated Aug. 31, 2020, for Zhang Xunhua International Application No. PCT/IB2020/055343, filed Jun. 6, 2020.
(Continued)

*Primary Examiner* — Quang D Thanh
(74) *Attorney, Agent, or Firm* — Law Offices of Albert Wai-Kit Chan, PLLC

(57) ABSTRACT

An acumoxa therapy device utilizes energy waves for preventing, alleviating or treating COVID-19 (SARS-CoV-2) coronavirus infection. In one embodiment, the device delivers energy in a non-invasive manner. In one embodiment, the device is configured to include an energy pin and one or more energy rings. In one embodiment, the device delivers sufficient energy to certain body parts such as acupoints to achieve an intervening and/or therapeutic effect. In one embodiment, the device maintains or improves general health, or alleviates or treats a subject with COVID-19 infection and one or more other conditions.

17 Claims, 5 Drawing Sheets

Related U.S. Application Data

(60) Provisional application No. 62/858,072, filed on Jun. 6, 2019.

(51) Int. Cl.
*A61H 39/04* (2006.01)
*A61H 23/02* (2006.01)

(52) U.S. Cl.
CPC .... *A61H 23/0236* (2013.01); *A61H 2201/501* (2013.01); *A61H 2201/5048* (2013.01)

(58) Field of Classification Search
CPC .... A61H 2201/0153; A61H 2201/1685; A61H 2201/0157; A61H 2201/105; A61H 23/02; A61H 39/002; A61H 39/086; A61H 39/04; A61H 2201/501; A61H 2201/5048; A61M 5/3298; A61M 5/46; A61M 37/0015; A61M 2025/0085; A61M 2037/0023; A61M 37/0092; A61M 2037/0061; A61M 2037/0007; A61M 2037/0046; A61N 7/00; A45D 44/02; A45D 2200/207
See application file for complete search history.

(56) References Cited

U.S. PATENT DOCUMENTS

| | | | | |
|---|---|---|---|---|
| 9,770,280 | B2 | 9/2017 | Diederich et al. | |
| 10,245,444 | B2 | 4/2019 | Tatsumura Hillyer et al. | |
| 2005/0085879 | A1* | 4/2005 | Ahn | A61H 39/06 607/96 |
| 2005/0207609 | A1* | 9/2005 | Oser | A61H 23/0218 381/396 |
| 2006/0270956 | A1* | 11/2006 | Wong | A61H 39/04 601/108 |
| 2016/0101010 | A1 | 4/2016 | Hsu | |
| 2016/0184173 | A1* | 6/2016 | Chen | A61F 7/007 601/18 |
| 2018/0116687 | A1* | 5/2018 | Choe | A61B 17/3423 |
| 2018/0296432 | A1 | 10/2018 | Warlick et al. | |
| 2019/0151193 | A1* | 5/2019 | Van Den Ende | A61H 39/04 |
| 2020/0101307 | A1* | 4/2020 | Marcantonio | A61N 2/002 |

FOREIGN PATENT DOCUMENTS

| | | | |
|---|---|---|---|
| CN | 102512315 | A | 6/2012 |
| CN | 202554761 | U | 11/2012 |
| CN | 202802550 | U | 3/2013 |
| CN | 203139398 | U | 8/2013 |
| CN | 204092851 | U | 1/2015 |
| CN | 104721970 | A | 6/2015 |
| CN | 104922805 | A | 9/2015 |
| CN | 106038245 | A | 10/2016 |
| CN | 206120697 | U | 4/2017 |
| CN | 206120698 | U | 4/2017 |
| CN | 107998502 | A | 5/2018 |
| CN | 109363929 | A | 2/2019 |
| KR | 20130081065 | A | 7/2013 |

OTHER PUBLICATIONS

Written Opinion of the International Search Authority, dated Aug. 31, 2020, for Zhang Xunhua, International Application No. PCT/IB2020/055343, filed Jun. 6, 2020.

Taiyi Institute. Healing Materials. Available at https://www.taiyi-institute.com. Printed on Aug. 14, 2020.

Zohuri et al. Electrical Brain Stimulation for the Treatment of Neurological Disorders. Journal of Health Science. vol. 7, pp. 123-128, (2019).

Boyd-Brewer et al. Vibroacoustic Sound Therapy Improves Pain Management and More. Holistic Nursing Practice. vol. 18, Issue 3, p. 111-118 (2004).

Lawrence Leung. Traditional Chinese Medicine—a beginner's guide. InnovAiT. vol. 4, Issue 1, pp. 49-54, Nov. 2010.

* cited by examiner

DEVICE FOR ACUPUNCTURE AND MOXIBUSTION THERAPY AND USES THEREOF

CROSS-REFERENCE TO RELATED APPLICATIONS

This application is a continuation-in-part application of International Application No. PCT/IB2020/055343, filed Jun. 6, 2020, which claims the priority of Chinese Patent Application No. 202010222365.4, filed Mar. 26, 2020, and U.S. Provisional Application No. 62/858,072, filed Jun. 6, 2019. The entire contents and disclosures of the preceding applications are incorporated by reference into this application.

Throughout this application, various publications are cited. The disclosures of these publications in their entireties are hereby incorporated by reference into this application to more fully describe the state of the art to which this invention pertains.

FIELD OF THE INVENTION

The present invention relates to a device for acupuncture therapy and moxibustion therapy ("acumoxa therapy" below) utilizing energy waves, e.g., sound waves, and also relates to method of using the device. The device avoids the side effects of traditional acumoxa therapy.

BACKGROUND OF THE INVENTION

Acumoxa therapy is a combination of acupuncture therapy and moxibustion therapy. Acupuncture therapy treats diseases by inserting thin needles into the body at certain pressure points or synonymously acupuncture points ("acupoints" below) and transmitting vibrations into the body by acupuncture techniques, such as twirling and lifting. Moxibustion therapy treats diseases by applying burnt mugwort to certain acupoints to smolder the skin and transmit heat energy into the body. By combining the vibrations of acupuncture and the heat energy of moxibustion transmitted into the body, acumoxa therapy activates the body's self-regulating functions for health benefits and medical treatment.

Treatment by acupuncture therapy has many advantages: (1) applicable to a wide range of indications and diseases by doctors specialized in internal medicine, surgery, gynecology, pediatrics, ENT (ear, nose, and throat) and eye care; (2) rapidly noticeable effect which, in particular, revitalizes the body functions, enhances resistance to diseases, calms patients and relieves pain; (3) simple and easy operation; (4) typically low cost; (5) safe, reliable and can cooperate with other therapies in comprehensive treatment. Therefore, acupuncture therapy is well received by people.

Acupuncture therapy also has disadvantages. People may fear the needles used in acupuncture therapy, as the needles may pierce through blood vessels under the skin and cause side effects. Use of moxibustion therapy can be difficult in that certain amount of heat is required for it to be effective, whereas excess heat may easily burn the skin and cause side effects.

To overcome the disadvantages of traditional acumoxa therapy, inventions and products use sound waves and associated vibrations and energy thereof as substitutes for vibrations of needles and heat energy of burnt mugwort. In one aspect, many inventions use sound waves in the ultrasonic frequency range, whereas the present invention takes advantage of the comparatively safer acoustic sound waves. In one aspect, effective delivery of sufficient energy to acupoints is still challenging. CN 102512315A disclosed a device using sound waves for physical therapy without any measures to concentrate or focus the energy delivery. The Chinese Patent No. CN 101284163B concentrated the energy waves by using an ultrasonic transducer with a unit adjusting the focus of ultrasonic waves. The Chinese Patent Application Publication No. CN 102397652A disclosed use of both sound waves and bioelectric pulses. The Chinese patent application publication no. CN 106038245A disclosed use of a resonator generating resonant vibrations to stimulate the acupoints. The Chinese Utility Model Patent No. CN 202554761U disclosed a housing comprising multiple holes so as to maximize effective delivery of sound waves. The Chinese Utility Model Patent Nos. CN 203139398U, CN 206120697U and CN 206120698U utilized a power amplifier. The Chinese Utility Model Patent No CN 204092851U and the US Patent Publication No. US20160101010A1 used two conductive outputting units. U.S. Pat. No. 4,895,149 disclosed a general non-invasive therapy apparatus by using a selected wave particular to organs without any measure directed to effective delivery of energy. US Patent No. U.S. Ser. No. 10/245,444B2 disclosed the use of a unit generating far infrared heat energy to be delivered to human body. US Patent Publication No. US20180296432A1 disclosed use of acoustic wave generator generating shock waves.

An effective and efficient delivery of sufficient energy to the acupoints or certain body parts is still highly needed. The present invention provides a device with a unique but simple structure that can effectively and efficiently delivery energy to the body parts or acupoints to achieve the desired therapeutic effects. In one embodiment, the device is characterized by an energy pin (103) and one or more energy rings (104) configured to achieve the above effects. In one embodiment, the present invention is characterized by using acoustic sound waves selected, generated or composed based on the Chinese musicological theory (1-3). In another embodiment, the acoustic waves are selected based on an established connection between matter, sound wave energy, and mental and physical health of human-beings.

SUMMARY OF THE INVENTION

The device (100) of the present invention uses an energy pin (103), rather than the thin needles seen in traditional acupuncture therapy. The energy pin (103) is a blunt metal pin that is placed inside the housing (101) of the device (100). Vibrations of energy waves drive the energy pin (103) to transfer energy into the body. The device (100) uses vibrations of energy waves to replace the twirling and lifting of acupuncture techniques and uses energy that is augmented by energy rings (104) to replace the heat energy in moxibustion therapy. As a result, the device (100) of the present invention can simulate the health benefits of traditional acumoxa therapy. The device (100) does not puncture or burn the skin, so there is no side effect. While relaxing the body and mind, relieving pain and/or achieving certain intervening or therapeutic effects in a subject, the device (100) avoids the above-mentioned disadvantages of traditional acumoxa therapy.

In one embodiment, the device as configurated in this invention can deliver exogenous energy into the human body. In another embodiment, such exogenous energy may interact with and boost the endogenous energy of a subject. In one embodiment, said exogenous energy is capable of inducing the endogenous energy in the subject and activating or boosting the self-regulating functions of the human body. In one embodiment, said energy waves are sound waves. Sound waves can travel in three kinds of matter, i.e., solid, liquid, and gas, and their travelling speed is usually higher in liquid than in gas, and even higher in solid than in liquid. Sound waves can propagate across the interface between two different media and travel from one medium into another. As the densities of different media are different, sound waves are usually refracted when they travel across the interface. When certain conditions are met, resonance occurs in the medium in which sound waves propagate, and maximum amplitudes of vibrations are attained.

Blood circulation in animals is keenly related to their status of health. Propagation of energy waves (e.g., sound waves) in the body reopens occluded blood vessels, stimulates and improves blood circulation in both healthy and diseased tissues, increases blood flow rate and decreases blood viscosity, and increases the activity of globulins, oxygen molecules, negative ions, phagocytic cells and immunoglobulins in blood, thereby boosting resistance to diseases and helping diseased tissues to recover. Energy waves (e.g., sound waves) traveling in the body may cause resonance of the skeleton, and elimination of lipids, arterial plaques and toxic accumulation from the microcirculation, thereby improving blood circulation, relaxing the body and mind, and relieving pain.

DETAILED DESCRIPTION OF THE INVENTION

Figure 1:
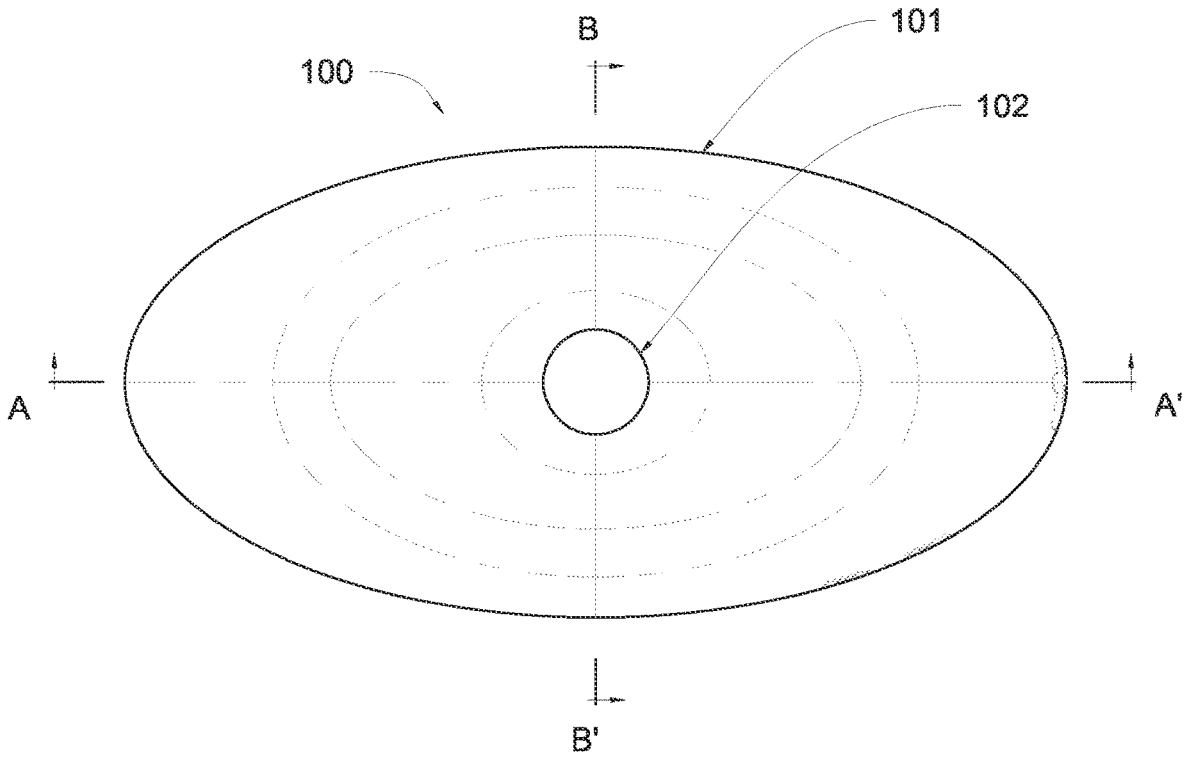
FIG. 1 is a top view of one embodiment of the device (100), wherein the bottom of the housing (101) of the device (100) is elliptical in shape. The protruding point (102) is shown at the center. Two cross-sectional views are shown in FIGS. 2 and 4 below.
Figure 2:
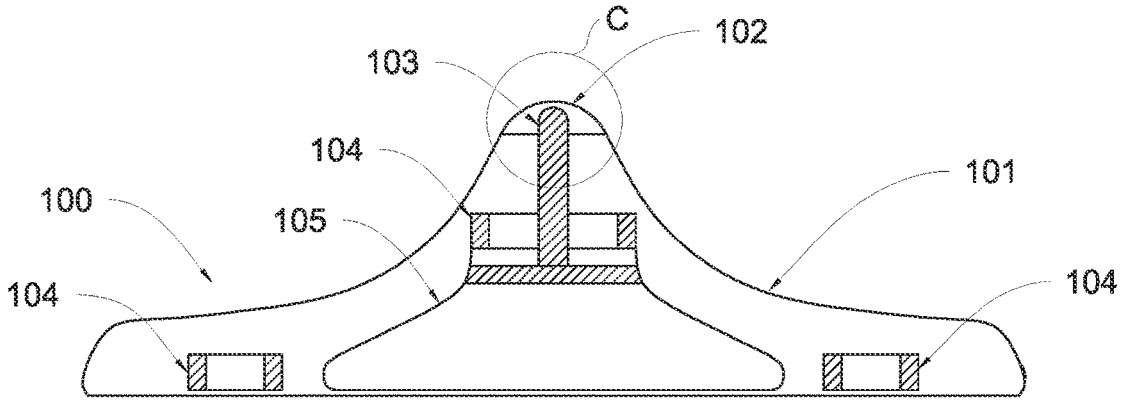
FIG. 2 is a cross-sectional view (with left-right symmetry) along the longitudinal axis of the bottom of the housing (101) of one embodiment of the device (100). The apex of the top is the protruding point (102), which is spherical in shape. Placed inside the device (100) are one energy pin (103), three energy rings (104) and one energy source (105) (e.g., a speaker). In one embodiment, the energy source (105) is a speaker wherein its front emits sound waves and faces the bottom of the housing (101). One energy ring (104) is placed around the energy pin (103) such that the longitudinal axis of the energy pin (103) is aligned with the central axis of the energy ring (104). The other two energy rings (104) are placed flat around the speaker (105). One end of the energy pin (103) is spherical in shape, can be of various curvature radii, and is in touch with the protruding point (102). The other end of the energy pin (103) is flat, surrounded by the one energy pin (103), and attached to the back of the speaker (105).
Figure 3:
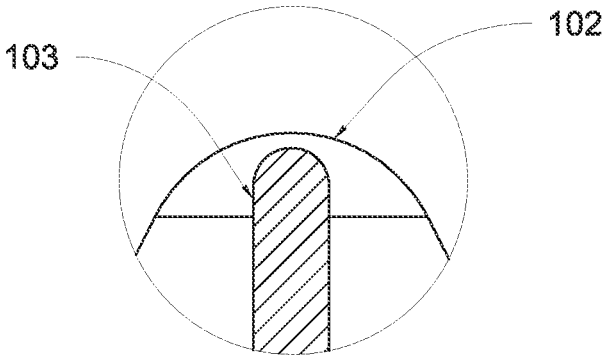
FIG. 3 is an enlarged view of the neighborhood of the protruding point (102) in FIG. 2. As shown, both the protruding point (102) and the upper end of the energy pin (103) are spherical in shape.
Figure 4:
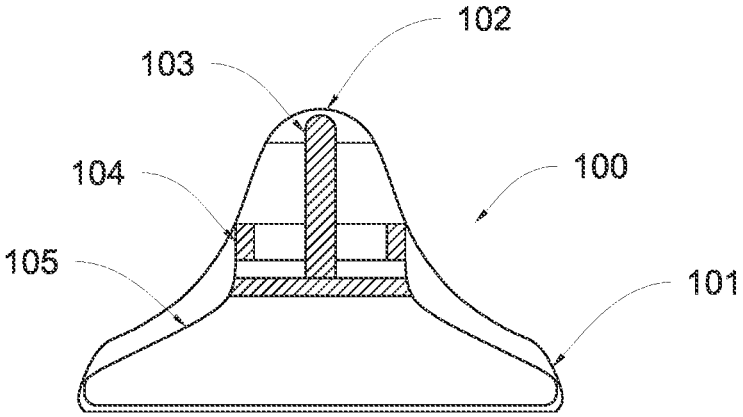
FIG. 4 is a cross-sectional view (with left-right symmetry) along the minor axis of the bottom of the housing (101) of one embodiment of the device (100). The front of the speaker (105) inside the housing (101) emits sound waves and faces the bottom of the housing (101).
Figure 5:
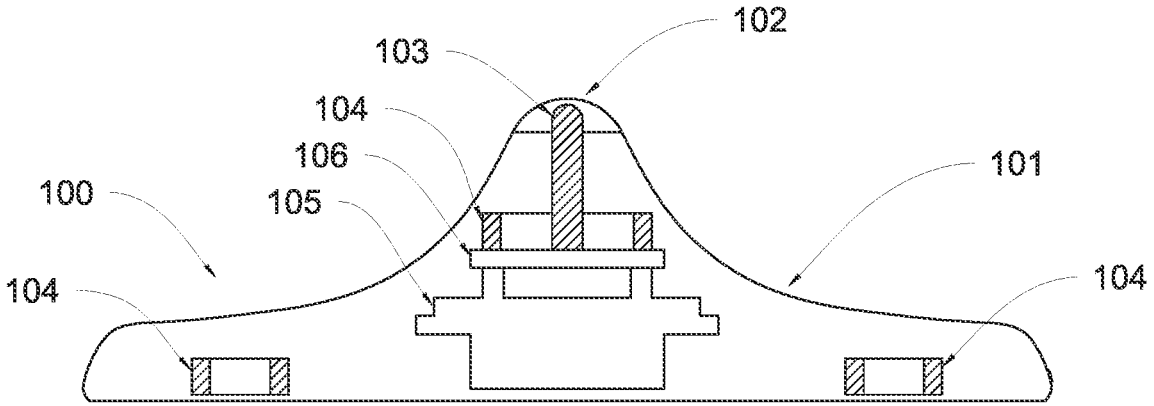
FIG. 5 is a cross-sectional view (with left-right symmetry) along the longitudinal axis of the bottom of the housing (101) of one embodiment of the device (100). The apex of the top is the protruding point (102), which is spherical in shape. Placed inside the device (100) are one energy pin (103), three energy rings (104) and one energy source (105) (e.g., a speaker). In one embodiment, the energy source (105) is a speaker wherein its front emits sound waves and faces the protruding point (102). A stand (106) is placed on top of the speaker's (105) front. One energy ring (104) is placed around the energy pin (103) such that the longitudinal axis of the energy pin (103) is aligned with the central axis of the energy ring (104). The other two energy rings (104) are placed flat around the speaker (105). One end of the energy pin (103) is spherical in shape, can be of various curvature radii, and is in touch with the protruding point (102). The other end of the energy pin (103) is flat, surrounded by the one energy pin (103), and attached to the back of the speaker (105).
Figure 6:
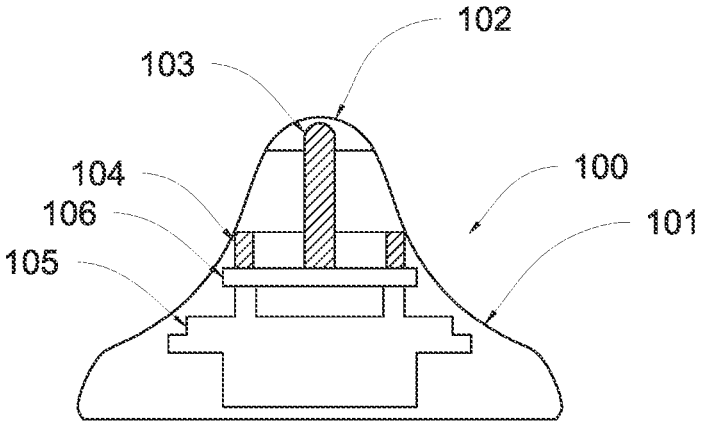
FIG. 6 is a cross-sectional view (with left-right symmetry) along the minor axis of the bottom of the housing (101) of one embodiment of the device (100). The front of the speaker (105) inside the housing (101) emits sound waves and faces the protruding point (102).
Figure 7:
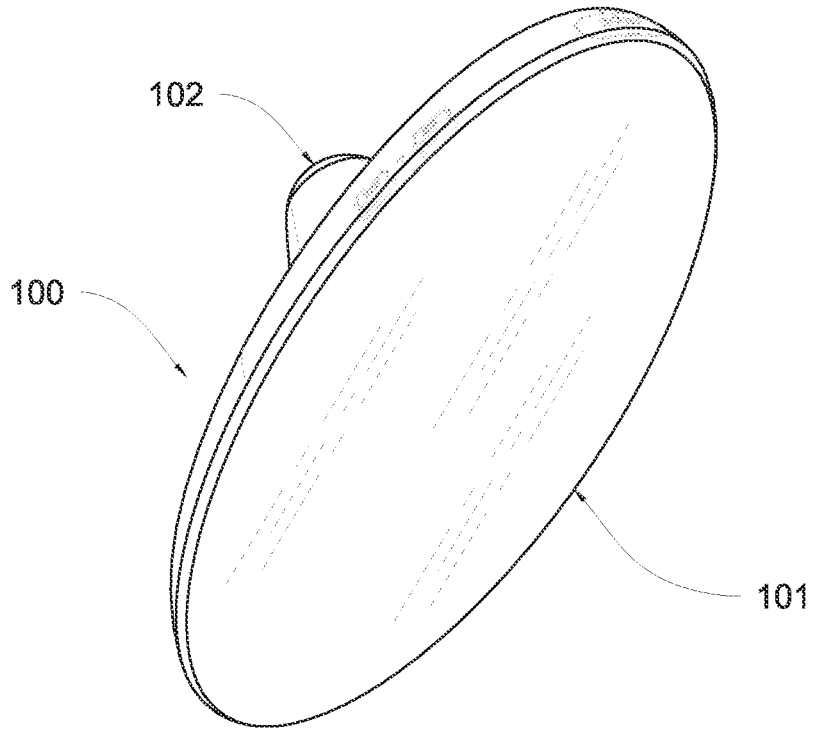
FIG. 7 is a perspective view of one embodiment of the device (100) viewed from one perspective.
Figure 8:
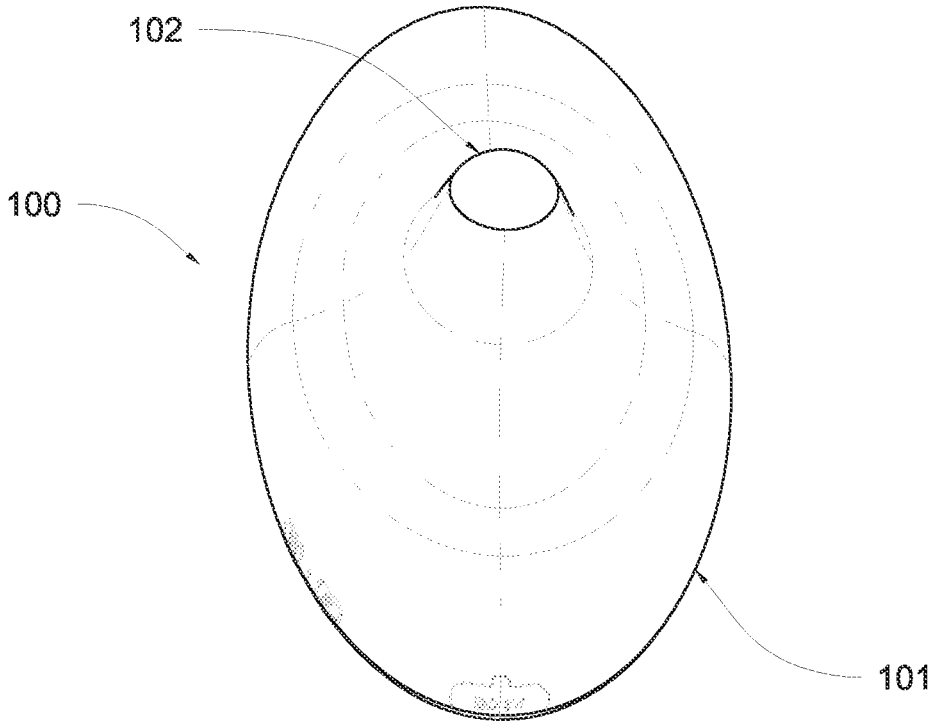
FIG. 8 is a perspective view of one embodiment of the device (100) viewed from another perspective.
Figure 9:
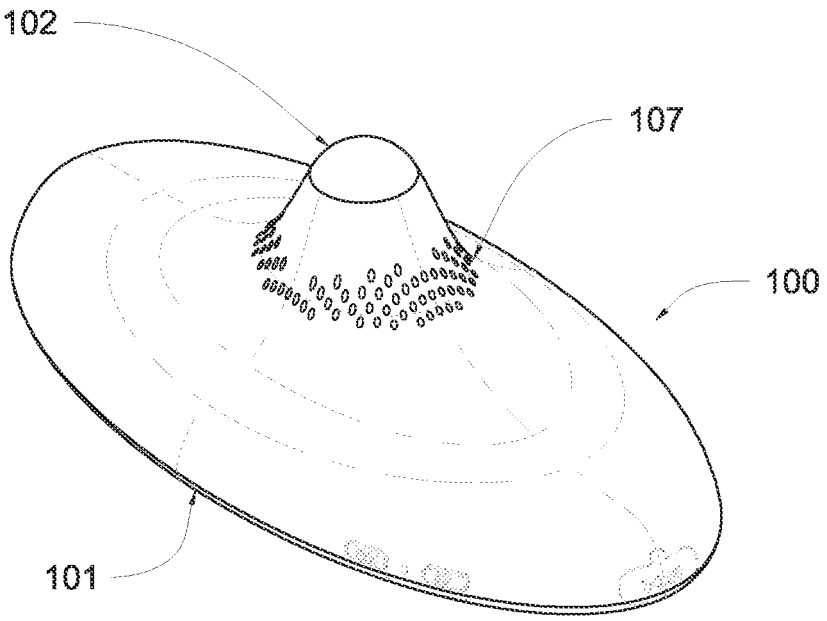
FIG. 9 is a perspective view of one embodiment of the device (100). The figure shows holes (107) in an area of the top of the housing (101) between the protruding point (102) and the energy source (105). The front of the energy source (105) inside the housing (101) emits energy waves and faces the protruding point (102). The energy waves can transmit through the holes (107) into a human body.

The device (100) of the present invention transmits energy waves through the body surface, activates the self-regulating functions of the body by transferring energy, and relaxes the body and mind and/or relieves pain, while avoiding the side effects of traditional acumoxa therapy. In one embodiment, said energy waves are sound waves.

The following terms shall be used to describe the present invention. In the absence of a specific definition set forth herein, the terms used to describe the present invention shall be given their common meaning as understood by those of ordinary skill in the art.

The housing (101) is usually made of plastic with a flat bottom that can be in any shape (such as ellipse). The arrangement of components inside the housing (101) determines its shape. A curved top gradually inclines upwards from the edge of the bottom towards the center to form a protruding point (102). The protruding point (102) is shaped in such a way as to be able to touch certain parts of a body where acupoints are located, whereby enhancing the operability and treatment effects of the device (100). The top can fit a human ischium, and the protruding point (102) can fit areas of the body close to some important acupoints of the human meridians (such as the Huiyin acupoint, the Shenque acupoint, etc.). Therefore, the device (100) is capable of effectively transferring energy from the energy source (105) inside the device (100) into the body to bring about the benefits of acumoxa therapy. The housing (101) contains various components inside, such as energy rings (104), energy pin (103) and energy source (105) (details below).

The energy rings (104) are made of stone material and manufactured into rings in shape. The ingredients of the stone material comprise micrite (as much as 80% to 99% by volume), and one or more of ferrous sulfide, calcium, magnesium, zinc, chromium, antimony, selenium, titanium, manganese, and rare earth elements. The energy rings (104) are placed inside the housing (101) to amplify the wave energy. One energy ring (104) may be placed between the energy source (105) and the protruding point (102) to encircle an energy pin (103), with its central axis aligning with the longitudinal axis of the energy pin (103). By efficiently reflecting the energy waves, the energy rings (104) focus the energy waves to transmit along one direction, such as in alignment with the central axis of the energy rings (104), so that the efficiency of wave transmission, treatment effects and health benefits are enhanced by using the device (100) of the present invention. Compared to an alternative configuration lacking the energy rings (104), with all other components and configuration remaining the same, the present invention equipped with energy rings (104) achieves an enhancement of efficiency of about 30% to 40%.

The energy pin (103) are blunt and made of metal material. They usually have one end flat and the other end spherical in shape which can be of various curvature radii. The energy pin (103) are usually made of iron and placed inside the housing (101). One energy pin (103) passes through an energy ring (104) such that the longitudinal axis of the energy pin (103) aligns with the central axis of the energy ring (104). The spherical end of the energy pin (103) is in touch with the protruding point (102), and the flat end is pointing towards the front or the back of the energy source (105), allowing energy to transfer efficiently from the energy source (105) to the protruding point (102). Energy waves, such as sound waves, travels faster in the energy pin (103) typically made of metal or alloy than they do in air. By providing a highway for wave transmission between the energy source (105) and the protruding point (102), the energy pin (103) enhances the efficiency of wave transmission, treatment effects and health benefits by using the device (100) of the present invention. Compared to an alternative configuration lacking the energy pin (103), with all other components and configuration remaining the same, the present invention equipped with the energy pin (103) achieves an enhancement of efficiency of about 10% to 20%.

Compared to an alternative configuration lacking both the energy rings (104) and the energy pin (103), with all other components and configuration remaining the same, the present invention equipped with the energy rings (104) and the energy pin (103) achieves an enhancement of efficiency of about 40% to 60%.

The energy source (105) generates energy waves that can transmit through the body surface. Transmission of the energy waves within the body can activate the body's self-regulating functions to relax the body and mind and to relieve pain, while avoiding the side effects of traditional acumoxa therapy. The energy source (105) may have a front and a back, wherein the front emits energy waves. In one embodiment, said energy source (105) is a speaker, such as one commonly used as audio equipment, with power of approximately 10 watts and adjustable volume. The front of the speaker (105) may face the bottom of the housing (101), with the flat end of one energy pin (103) attached to the back of the speaker (105). Alternatively, the front of the speaker (105) may face the protruding point (102), with a stand (106) placed on top of the speaker (105) so that the flat end of one energy pin (103) is attached to the stand (106) with the spherical end of the energy pin (103) pointing towards the protruding point (102).

The present invention provides a sound wave therapy, i.e., a system and a method for maintaining or improving general health, or for alleviating or treating a condition in a subject by effectively delivering energy to the subject. The sound waves can be audible sound with frequency between 20 Hz and 20 kHz, or ultrasonic waves with frequency over 20 kHz, and in some occasion infrasonic waves with frequency lower than 20 Hz. In practice, the sound waves may be music of any kind, vocal sound of a human, any other kinds of sound, noisy sound such as white or pink noises, or any combination of the aforementioned sounds. In the present invention, the energy source (105) inside the device (100) generates energy waves including sound waves of recorded chanting of pithy formulas by the inventor that have treatment effects and health benefits for a set of diseases, which are optionally modulated together with music composed based on the Chinese musicological theory and other wave components such as those converted from the inventor's physiological measurements (e.g., heartbeats and brainwaves) during the process when the inventor treats patients. Energy waves that can be generated and utilized by the present invention include optical waves or electromagnetic waves such as infrared waves; sound waves including infrasonic waves, acoustic waves and ultrasonic waves; electrical waves such as those converted from other signals included the inventor's brainwaves and heartbeats; and other types of energy waves existing and collectible in the natural world. The device (100) of the present invention, by transmitting energy waves into a human's body, induces vibrations in the body to benefit the human physically and physiologically, as well as mentally and spiritually. Resonance occurs when the frequency of the engendered vibrations matches the intrinsic frequency of a human's body, such as the intrinsic frequency of the human's skeleton, muscle, blood vessels, and even cells found in various organs and tissues. When resonance occurs, maximum treatment effects are achieved for the optimal health benefits. In one embodiment, induced vibration and/or resonance in the body can eliminate dead body cells and harmful microorganisms (e.g., bacteria and viruses), thus enhancing the body's immunity.

An effective dose for alleviating or treating a disease including the COVID-19 infection is defined as a dose of energy that can effectively cure the disease or cause the related symptoms disappear. In one embodiment, an effective dose of the therapy is expressed by the total watt hours of energy emitted by the device (100), when it is used to deliver therapeutic energy to one or more body parts such as acupoints. In one embodiment, with the energy source (105) having a power of approximately 10 watts, an effective dose of energy may range from 30 minutes to 6 hours of continuous or cumulative use of the device (100) per day, which is equivalent to 5 to 60 watt hours of energy emitted. In one embodiment, an effective dose is equivalent to 30 minutes of continuous or cumulative use of the device (100) per day with the energy source (105) having a power of approximately 10 watts. In one embodiment, an effective dose of energy is equivalent to 3 hours of continuous or cumulative use of the device (100) per day with the energy source (105) having a power of approximately 10 watts. In one embodiment, an effective dose is equivalent to 4 to 6 hours of continuous or cumulative use of the device (100) per day with the energy source (105) having a power of approximately 10 watts. In one embodiment, an effective dose is equivalent to 24 hours of continuous use of the device (100) with the energy source (105) having a power of approximately 10 watts. In one embodiment, when multiple devices are used, an effective dose of energy is the sum of the energy emitted by all devices.

The Chinese musicological theory (see references 18-19) is based on Chinese philosophy and reveals connections between the five natural elements, five major scales, and five important internal organs of a human. The five major scales are often termed the Five Sounds and used to treat patients in traditional Chinese medicine. Table 1 enumerates the name of the Five Sounds and the elements and organs they are associated with.

In one embodiment, the device of the present invention utilizes sound waves with specific frequencies corresponding to the organs of a human, for example, as disclosed in U.S. Pat. No. 4,895,149, a frequency of 64 Hz corresponding to liver, 54 Hz corresponding to heart, 81 Hz corresponding to spleen, 72 Hz corresponding to lungs, and 48 Hz corresponding to kidney.

TABLE 1

Names of the Five Sounds and their Associated Elements and Organs

| Name of Sound | Associated Element | Associated Organ |
|---|---|---|
| Gong | Earth | Spleen |
| Shang | Metal | Lung |
| Jue | Wood | Liver |
| Zhi | Fire | Heart |
| Yu | Water | Kidney |

In traditional Chinese medical practices, it is common to refer to a major scale in above table by either its name, or the element or the organ it corresponds to. For example, in this disclosure, the "Gong Sound" is used interchangeably with the "Earth Sound" and the "Spleen Sound", and so forth.

Diagnosis by Looking (i.e., Observation) is commonly practiced in traditional Chinese medicine, and is particularly important in determining the overall state and prognosis of an imbalance in a subject (6). During Diagnosis by Looking, a traditional Chinese medical practitioner observes a subject's eyes, ears, tongue, nose, complexion, body posture and bone structure, which may reveal vital information about a subject's vitality and mental, emotional, and spiritual well-beings. With the aid of online communication tools such as video conference software, Telediagnosis by Looking may be practiced remotely over the internet.

The pithy formulas are a series of phrases and sentences that can be recited, and are summarized by the inventor through his practice with or without assistance of artificial intelligence which can provide more insights into the correlation between the features and their potential therapeutic effects to certain conditions or diseases. When pithy formulas are recited, energy waves are generated; such energy waves are termed Meditation Electronic Waves (MEWs), which carry information and energy. Unlike the other kinds of waves, MEWs are capable of efficiently transmitting into the body to bring about resonance when propagating in the body.

The acupoints (also termed as pressure points) are spots located on a subject's body surface where applying concentrated pressure by a fingertip or an acupuncture needle may promote the subject's health and alleviate, improve and cure the subject's symptoms and diseases. Examples of acupoints in common practice of traditional Chinese medicine include (1) the Huiyin acupoint in the proximity of a subject's anus and human ischium; (2) the Qugu acupoint at the pubic symphysis; (3) the Shenque acupoint near a human's navel; (4) the Fengfu acupoint around a human's ear; (5) the Danzhong acupoint in front of a human's chest; (6) the Yongquan acupoint on the bottom of a human's foot; (7) the Xuanzhong acupoint on the outside of a human's leg, about 3 inches above the ankle; (8) the Sanyinjiao acupoint on the inside of a human's leg, about 3 inches above the ankle; and (9) the Chengshan acupoint in the center of the back of a human's leg.

The exogenous energy comprises energy generated by an external device (e.g., energy sources). Examples abound, such as solar energy emitted from the sun; heat energy emitted from a heater; light or optical energy emitted from a light-emitting diode; mechanical energy transferred in the transmission of sound waves; electromagnetic energy carried by electromagnetic radiation; and so forth. Use of this term is to differentiate energy referred in a context from any energy generated by or inside a human body. The latter is termed endogenous energy (see description below).

The endogenous energy comprises energy generated by or inside a human body, with examples such as heat or thermal energy; kinetic energy including human locomotion, heart beats, and activities of other organs; electromagnetic energy including electrical signaling in the nervous system; chemical energy including chemical signaling in the endocrine system and metabolism in general; infrared radiation; and other types of energy that a human body generates while it maintains normal function and activity.

In one embodiment, as used herein, the intervening effects lead to effective maintenance or improvement of general health, or alleviation or treatment of a condition in a subject. In one embodiment, the intervening effects include those that can be scientifically, medically or clinically evidenced; those that can be empirically evidenced, such as mood; and those that are debatably categorized under either of the above.

The intervening measures mean any parameters for describing, either quantitatively or qualitatively, an intervening effect on one or more conditions. In one embodiment, the intervening effect includes but is not limited to maintenance of energy level, stabilization of mood, enhancement of happiness, medication, improvement to surgery or post-surgery recovery, and other medical interventions. In one embodiment, the intervening effect may also refer to maintenance or change of a status either physically or spiritually. In one embodiment, the intervening effect may be medically or clinically evidenced, or otherwise.

Studies have noted that exogenous energy may have an influence on the endogenous energy of a human body, and such an influence may be applied in treatment of a condition in a subject. Exogenous electric signals can stimulate endogenous electric signals in the central nervous system for the treatment of neurological disorders (4). As mentioned, exogenous vibrational energy of needles and heat energy of burnt mugwort are applied in traditional acumoxa therapy to interact with endogenous energy in the main systems of the human body, such as the peripheral nervous system, the circulatory system, the muscular system, and the immune system. Vibrations and audible sound waves may be effective to invoke relaxation, alleviate stress, and improves pain management (5). The device of the present invention transfers sound wave energy into the body to stimulate endogenous energy for intervening effect (see below for indications and their treatment enabled by the device of the present invention).

The stand (106) is used for fixation of the flat end of an energy pin (103).

In one embodiment, the device (100) of the present invention comprises the following:

(1) A housing (101) approximately 120 to 180 millimeters in length, approximately 64 to 96 millimeters or approximately 50 to 100 millimeters in width, and approximately 47 to 67 millimeters or approximately 20 to 90 millimeters in height. The housing (101) has a flat bottom and a curved top fitting a human ischium, which is an important structure in human skeleton.

(2) A protruding point (102) spherical in shape as part of the top of the housing (101). The protruding point (102) is configured to be able to touch the body parts where acupoints are located so as to transmit energy waves into the body. The base diameter of the protruding point (102) is approximately 3 to 12 millimeters or approximately 6 to 30 millimeters, wherein, when the base diameter of the protruding point (102) is approximately 20 millimeters, the corresponding curvature radius of the sphere is approximately 3.2 to 16 millimeters or approximately 10.7 millimeters, and the corresponding height of the sphere is approximately 2.1 to 10.4 millimeters or approximately 6.9 millimeters. When the base diameter of the protruding point (102) is approximately 18 millimeters, the corresponding curvature radius of the sphere is approximately 3.2 to 16 millimeters or approximately 9.6 millimeters, and the corresponding height of the sphere is approximately 2.1 to 10.4 millimeters or approximately 6.2 millimeters. When the base diameter of the protruding point (102) is approximately 8 millimeters, the corresponding curvature radius of the sphere is approximately 1.6 to 6.4 millimeters or approximately 4.3 millimeters, and the corresponding height of the sphere is approximately 1 to 4.2 millimeters or approximately 2.8 millimeters. The actual dimensions of the device (100) depend on the need of patients in practice.

(3) A storage medium (store) for storing audio files which are a series of recorded pithy formulas.

(4) An energy source (105), e.g., a speaker of approximately 10 watts with adjustable volume. The speaker (105) plays the recorded audios of the pithy formulas and is the energy source (105) of the energy waves, i.e., sound waves.

(5) An energy pin (103) which is approximately 4 to 6 millimeters in diameter. The energy pin (103) is a blunt metal pin usually made of iron. One end of the energy pin (103) is pointing towards the front of or the back of the speaker (105), and the other end of the energy pin (103) is in touch with the protruding point (102). The energy of sound waves generated by the speaker (105) can be efficiently transferred to the protruding point (102). Furthermore, said housing (101) comprises holes (107) in an area of the top of the housing (101) between the protruding point (102) and the energy source (105), and sound waves can transmit through the holes (107). The size and distribution of the holes (107) can vary based on actual need in practice.

(6) Energy rings (104) which are approximately 4.8 to 7.2 millimeters in height. Difference between the inner and outer diameters of the energy rings (104) is approximately 4.8 to 7.2 millimeters, and the outer diameter is approximately 16 to 28 millimeters. The energy rings (104) are made of materials comprising micrite and are manufactured into a ring shape. The energy rings (104) are used to amplify the energy of sound waves. One energy ring (104) can be placed encircling an energy pin (103) between the speaker (105) and the protruding point (102), with its central axis aligning with the longitudinal axis of the energy pin (103). The remaining energy rings (104) can be placed flat around the speaker (105).

In one embodiment, the housing (101) is waterproof. In one embodiment, only a part of the housing is waterproof. In one embodiment, the top or bottom of the house is waterproof. In one embodiment, the housing or a part thereof absorbs a negligible fraction of the sound waves. In one embodiment, the device (100) of the present invention is approximately 57 millimeters tall. The bottom of the housing (101) is elliptical in shape, with a major axis of approximately 150 millimeters and a minor axis of approximately 80 millimeters. The protruding point (102) has a diameter of approximately 8 millimeters, a height of approximately 2.8 millimeters, and a curvature radius of approximately 4.3 millimeters. The device (100) contains an energy source (105) at the center, and the front of the energy source (105) faces the bottom of the housing (101) or the protruding point (102). The device (100) contains three energy rings (104) whose outer diameters are approximately 16 millimeters, approximately 28 millimeters and approximately 16 millimeters, respectively. The energy rings (104) are approximately 6 millimeters in height, and the difference between inner and outer diameters is approximately 6 millimeters. The largest energy ring (104) by diameter is placed between the protruding point (102) and the energy source (105), and the two smaller energy rings (104) are placed on the two sides of the energy source (105). The device (100) contains an energy pin (103), approximately 5 millimeters in diameter, which passes through the largest energy ring (104) and aligns its longitudinal axis with the central axis of said energy ring (104). One end of the energy pin (103) is spherical in shape and in touch with the protruding point (102), and the other end is flat and pointing towards the front or the back of the energy source (105). The flat end of the energy pin (103) may be attached to a stand (106) when pointing towards the front of the energy source (105).

In one embodiment, the device (100) of the present invention is approximately 50 millimeters tall. The bottom of the housing (101) is elliptical in shape, with a major axis of approximately 160 millimeters and a minor axis of approximately 80 millimeters. The protruding point (102) has a diameter of approximately 20 millimeters, a height of approximately 6.9 millimeters, and a curvature radius of approximately 10.7 millimeters. The device (100) contains an energy source (105) at the center, and the front of the energy source (105) faces the bottom of the housing (101) or faces the protruding point (102). The device (100) contains three energy rings (104) whose outer diameters are approximately 16 millimeters, approximately 28 millimeters and approximately 16 millimeters, respectively. The energy rings (104) are approximately 6 millimeters in height, and the difference between inner and outer diameters is approximately 6 millimeters. The largest energy ring (104) by diameter is placed between the protruding point (102) and the energy source (105), and the two smaller energy rings (104) are placed on the two sides of the energy source (105). The device (100) contains an energy pin (103), approximately 5 millimeters in diameter, which passes through the largest energy ring (104) and aligns its longitudinal axis with the central axis of said energy ring (104). One end of the energy pin (103) is spherical in shape and in touch with the protruding point (102), and the other end is flat and pointing towards the front or the back of the energy source (105). The flat end of the energy pin (103) may be attached to a stand (106) when pointing towards the front of the energy source (105).

In one embodiment, the device (100) of the present invention is approximately 50 millimeters tall. The bottom of the housing (101) is elliptical in shape, with a major axis of approximately 160 millimeters and a minor axis of approximately 80 millimeters. The protruding point (102) has a diameter of approximately 18 millimeters, a height of approximately 6.2 millimeters, and a curvature radius of approximately 9.6 millimeters. The device (100) contains an energy source (105) at the center, and the front of the energy source (105) faces the bottom of the housing (101) or faces the protruding point (102). The device (100) contains three energy rings (104) whose outer diameters are approximately 16 millimeters, approximately 28 millimeters and approximately 16 millimeters, respectively. The energy rings (104) are approximately 6 millimeters in height, and the difference between inner and outer diameters is approximately 6 millimeters. The largest energy ring (104) by diameter is placed between the protruding point (102) and the energy source (105), and the two smaller energy rings (104) are placed on the two sides of the energy source (105). The device (100) contains an energy pin (103), approximately 5 millimeters in diameter, which passes through the largest energy ring (104) and aligns its longitudinal axis with the central axis of said energy ring (104). One end of the energy pin (103) is spherical in shape and in touch with the protruding point (102), and the other end is flat and pointing towards the front or the back of the energy source (105). The flat end of the energy pin (103) may be attached to a stand (106) when pointing towards the front of the energy source (105).

In one embodiment, the device (100) of the present invention contains only one energy ring (104) placed between the energy source (105) and the protruding point (102), encircling an energy pin (103), with the energy ring's (104) central axis aligning with the longitudinal axis of the energy pin (103).

In one embodiment, the device (100) of the present invention contains three energy rings (104). One energy ring (104) is placed between the energy source (105) and the protruding point (102), encircling an energy pin (103), with the energy ring's (104) central axis aligning with the longitudinal axis of the energy pin (103). The remaining two energy rings (104) are placed around the energy source (105).

The energy waves of the pithy formulas have frequencies of 60 Hz to 300 Hz, and have the benefits of mitigating and/or treating a range of diseases. For different diseases, the inventor uses different pithy formulas to generate and record different MEWs. At least 30 patients were present on site for recording each pithy formula. The inventor first recites a pithy formula for approximately 30 minutes and, if the symptoms are relieved in more than 90% of the patients, the inventor then decides that the pitchy formula can be recorded and used in therapy. Currently, well-developed pithy formulas include a formula for relaxing and relieving stress, a formula for relieving and treating pain, a formula for heart therapy, a formula for liver therapy, a formula for spleen therapy, a formula for lung therapy and a formula for kidney therapy.

The pithy formulas undergo a process of continuous improvement, and the information and energy in the MEWs are enhanced. Unlike common kinds of energy waves (such as sound waves), once the MEWs are transmitted to the ischium at the center of a human skeleton, the MEWs can cause the skeleton to resonate, and the resonance propagates throughout the organs of the body. When the frequency of the MEWs of the pithy formulas is consistent with the physiological frequency of the body, the MEWs can directly affect heart rates, pulses and respiratory rate, and indirectly affect other physiological indicators such as brain waves and blood pressure, thereby relaxing the body and mind. At the same time, the MEWs help healthy tissues to prevent diseases and diseased tissues to recover, beneficial to the relief of symptoms, treatment of diseases and rehabilitation of patients.

In one embodiment, said energy source (105) is a speaker. The MEWs of the pithy formulas are recorded into a series of audios by electronic recording equipment. When the speaker (105) plays the audios, the vibrations of the speaker (105) contain the MEWs and drive the vibrations of the energy pin (103) pointing towards the front or the back of the speaker (105). The energy pin (103) transmits the vibrations to the protruding point (102) on the top of the housing (101), and the protruding point (102) in turn transmits the vibrations into the body. The energy rings (104) are used to amplify and/or improve the therapeutic effects of MEWs.

In one embodiment, the protruding point (102) makes contact with the Huiyin acupoint or the Shenque acupoint on the human body and effectively transmits the energy of waves from inside the device (100) into the body, whereby said energy waves, among others, propagate in the body.

The device (100) of the present invention can be operated via a smartphone app. Based on the courses of treatments needed by a user, the app can set the order and time of using the device (100) at different acupoints. In one embodiment, a course of treatment may include the order and time of using the device (100) at the following acupoints: (1) contacting the protruding point (102) with the Huiyin acupoint, located at the human pelvis, for 30 minutes; then (2) contacting the bottom of the housing (101) with the Qugu acupoint for 30 minutes; then (3) contacting the protruding point (102) with the Shenque acupoint for 30 minutes; then (4) contacting the bottom of the housing (101) with the Fengfu acupoint for 30 minutes; and finally (5) contacting the protruding point (102) with the Yongquan acupoint on the feet for 30 minutes. The app allows a user to choose different pithy formulas, adjust the intensity of energy waves, and record the number of uses. In one embodiment, either upon user's request or when deemed necessary by artificial intelligence (AI) algorithms, the app also provides technical supports, such as feedback on effects, manual of operation and health advisory services. In one embodiment, an AI-based assistant is made available online and termed the "TYQA Group of Health Care Experts".

The device (100) of the present invention provides a non-invasive treatment without skin damages to patients. Users can have the device (100) directly contact the body, or alternatively, load the device (100) into a bag and secure the bag on the body using ropes on two sides of the bag. In both situations, the protruding point (102) contacts the body can provide benefits of acumoxa therapy. In one embodiment, the bottom of the housing (101) may also contact the body or a part of the body to transfer energy for the effects of moxibustion therapy. The device (100) can relax the body and mind and relieve various pains in a subject, such as cervical pain, lumbar pain, joint pain, sciatica, and pain caused by sports injuries. The device (100) can also be used to relieve physical discomfort caused by various diseases (such as benign prostatic hyperplasia, prostate cancer, etc.), by surgery (such as uterine cancer surgery, etc.), or due to other reasons. In actual use, relaxing of the body and mind was reported in 100 cases, corresponding to a 96% rate of effectiveness. Pain relief was reported in 67 cases, corresponding to a 90% rate of effectiveness.

The present invention provides a device (100) for acumoxa therapy utilizing energy of sound waves to relax the body and mind, relieve pain, and achieve other intervening or therapeutic effects in a subject. In one embodiment, said device (100) comprises (a) a housing (101) of any shape and having a flat bottom and a curved top, wherein the top gradually inclines upwards from the edge of the flat bottom towards the center to form a protruding point (102); said housing (101) containing inside: (b) a storage medium for storing audio files; (c) a speaker (105), wherein said speaker (105) is placed at the center of said housing (101), and the front of said speaker (105) faces said bottom, and the back of said speaker (105) faces said protruding point (102); (d) an energy pin (103), wherein said energy pin (103) has a flat end attached to the back of said speaker (105), and the other end of said energy pin (103) is spherical in shape and is in touch with said protruding point (102); and (e) an energy ring (104) for amplifying or improving the therapeutic effect of said sound energy, or increasing the effective delivery of the sound energy and other energies to the body, target organ or area, wherein one energy ring (104) is placed encircling an energy pin (103) between said protruding point (102) and the back of said speaker (105), wherein the central axis of said energy ring (104) is aligned with the longitudinal axis of said energy pin (103), and other energy rings (104) are placed flat around said speaker (105); wherein said speaker (105) reproduces sound waves of pithy formulas stored in said storage medium, said sound waves propagating simultaneously in two directions, from the front of said speaker (105) to the bottom of said housing (101), and from the back of said speaker (105) to said protruding point (102), wherein both the front and the back of said speaker (105) continuously vibrate according to said sound waves, emitting Meditation Electronic Waves (MEWs).

In one embodiment, continuous propagation of sound waves of pithy formulas in the body for a minimum of 30 minutes relaxes the body and mind and/or relieves pain in a subject.

In one embodiment, the bottom of the housing (101) is elliptical in shape.

In one embodiment, the bottom of said housing (101) has an elliptical shape with a major axis of approximately 160 millimeters and a minor axis of approximately 80 millimeters, the height of said housing (101) is approximately 50 millimeters; said protruding point (102) is a spherical cap in shape with a base diameter of approximately 18 millimeters, a radius of approximately 9.6 millimeters, and a height of approximately 6.2 millimeters; said energy ring (104) has a height of approximately 6 millimeters, a difference between the inner and outer diameters of approximately 6 millimeters, and an outer diameter of approximately 16 millimeters or 28 millimeters; and said energy pin (103) has a diameter of approximately 5 millimeters.

In one embodiment, the present invention provides a device for acumoxa therapy, wherein said device comprises:

- a housing comprising a flat bottom and a curved top, wherein the curved top comprises
- a protruding point in the center; wherein the following are contained in said housing:
  - an elongated energy pin;
  - one or more energy rings; and
  - an energy source for generating energy waves, said energy source comprising a front and a back;
- wherein said energy source is placed in the center of said flat bottom, wherein one energy ring encircles said energy pin, which is placed longitudinally between said energy source and said protruding point.

In one embodiment, the front of said energy source emits said energy waves and faces the center of said bottom, or faces said protruding point.

In one embodiment, the energy pin comprises a flat end and a spherical end, wherein the flat end is pointing towards the back or front of said energy source, and said spherical end is in touch with the protruding point. In one embodiment, the curved top comprises one or more holes around said energy pin. In one embodiment, the energy waves have a frequency range of 60 Hz to 300 Hz. In one embodiment, the one or more energy rings primarily comprise micrite. In one embodiment, the housing has sockets on the flat bottom and placed around said energy source, each socket accommodating one energy ring.

In one embodiment, the device further comprises a storage medium (i.e., a store, or a data store) in said housing for storing audio files; said curved top gradually inclines upwards from the edge of the flat bottom towards the center to form said protruding point so that said protruding point can be in touch with a part of the human body where acupoints are located, allowing transmission of energy waves into the body; wherein said energy source is a speaker, wherein said energy waves are sound waves emitting from the front of said speaker facing either the bottom of said housing or said protruding point; said energy pin has two ends, with one end flat and attached to said speaker, and the other end spherical in shape and in touch with said protruding point; and said energy ring reflects said sound waves, causing said sound waves to transmit primarily along the central axis of said energy ring; wherein said device is used for maintaining or improving general health, or for alleviating and treating a condition in a subject.

In one embodiment, the ingredient of said energy ring comprises approximately 80% to 99% by volume of micrite, and one or more of ferrous sulfide, calcium, magnesium, zinc, chromium, antimony, selenium, titanium, manganese, and rare earth elements. In one embodiment, said energy ring comprises approximately 50% to 80% by volume of micrite.

In one embodiment, the length of said housing is 120 to 180 millimeters, the width of said housing is 50 to 100 millimeters, the height of said housing is 20 to 90 millimeters; said protruding point is a spherical cap in shape with a base diameter of 6 to 30 millimeters, a spherical radius of approximately 3.2 to 16 millimeters, and a height of approximately 2.1 to 10.4 millimeters; said energy ring has a height of 4.8 to 7.2 millimeters, a difference between the inner and outer diameters of 4.8 to 7.2 millimeters, and an outer diameter of 16 to 28 millimeters; and the diameter of said energy pin is 4 to 6 millimeters.

In one embodiment, the bottom of said housing has an elliptical shape with a major axis of approximately 160 millimeters and a minor axis of approximately 80 millimeters, the height of said housing is approximately 50 millimeters; said protruding point is a spherical cap in shape with a base diameter of approximately 20 millimeters, a spherical radius of approximately 10.7 millimeters, and a height of approximately 6.9 millimeters; said energy ring has a height of approximately 6 millimeters, a difference between the inner and outer diameters of approximately 6 millimeters, and an outer diameter of approximately 16 millimeters or 28 millimeters; and said energy pin has a diameter of approximately 5 millimeters.

In one embodiment, the present invention provides a system for maintaining or improving general health, or for alleviating or treating a condition of a subject comprising:

1) a device for acumoxa therapy, wherein said device comprises a housing comprising a flat bottom and a curved top, wherein the curved top comprises a protruding point in the center; wherein the following are contained in said housing:

an elongated energy pin;

one or more energy rings; and an energy source for generating energy waves, said energy source comprising a front and a back;

wherein said energy source is placed in the center of said flat bottom, wherein one energy ring encircles said energy pin, which is placed longitudinally between said energy source and said protruding point;

2) a computer processor;

3) one or more data stores storing:

a) audio files, each file characterized by features comprising frequency, amplitude, wavelength, waveform, velocity of wave, intensity; and b) a relational dataset that correlates one or more of said features to a plurality of conditions; and 4) a computer readable storage medium storing program instructions configured for execution by the computer processor to cause the system to:

a) identify a corresponding audio file upon an input of a condition;

b) retrieve said corresponding audio file from said one or more data stores to said energy source of said device; and c) deliver an exogenous energy through said device for maintaining or improving general health, or for alleviating or treating said condition.

In one embodiment, the audio file is identified by or with assistance of artificial intelligence which:

a) generates a training data set including said features of said audio files and a plurality of intervening and/or therapeutic measures to a plurality of conditions, b) trains, based on at least a subset of the training dataset, a predictive model configured to determine a predicted intervening and/or therapeutic effect of one of said audio files to one or more of said conditions, and, c) apply, with said input, said predictive model to said relational dataset to identify said corresponding audio file.

In one embodiment, the corresponding audio file is retrieved to said energy source via:

a) an internal connection that connects to said data stores stored within said device, b) a wireless connection that connects to said data stores stored at a computer or server, or c) an internet connection that connects to said data stores stored online.

In one embodiment, the present invention provides a method for maintaining or improving general health, or for alleviating or treating condition of a subject, comprising the steps of:

1) placing a device for acumoxa therapy in close proximity to one or more body parts of said subject, wherein said device comprises a housing comprising a flat bottom and a curved top, wherein the curved top comprises a protruding point in the center; wherein the following are contained in said housing:

an elongated energy pin;

one or more energy rings; and an energy source for generating energy waves, said energy source comprising a front and a back;

wherein said energy source is placed in the center of said flat bottom, wherein one energy ring encircles said energy pin, which is placed longitudinally between said energy source and said protruding point, and 2) delivering an exogenous energy to said one or more body parts by generating said energy waves with said energy source, thereby maintaining or improving general health, or alleviating or treating said condition.

In one embodiment, the device is placed with the protruding point or the flat bottom at close proximity with said one or more body parts.

In one embodiment, the one or more body parts comprise the Adam's Apple, the Heart Meridian of Upper Arm Inside and one or more acupoints of the Huiyin acupoint, the Qugu acupoint, the Shenque acupoint, the Fengfu acupoint, the Yongquan acupoint, the Sanyinjiao acupoint, the Danzhong acupoint, the Xuanzhong acupoint, and the Chengshan acupoint.

In one embodiment, the exogenous energy comprises one or more of the following: 1) energy waves emitted from said energy source but transmitted to the body via the said energy pin; 2) vibrations of said energy pin caused by said energy waves; 3) energy waves reflected from said energy rings; 4) secondary energy waves emitted from said energy rings upon stimulation of said energy waves, and 5) energy field of said energy rings. In one embodiment, the energy in various forms can harmonically and synergistically maintain or improve general health, or alleviate or treat said condition.

In one embodiment, the condition of said subject is affected by one or more of the following: COVID-19 infection, weakened immune system, neck pain and cervical spine disorder, low back pain and lumber spine disorder, knee pain, pain due to sports and/or injury, prostate diseases, gynecological diseases, hypertension, diabetes, cerebrovascular diseases, cardiovascular diseases, body stress and mental stress, dizziness, heart palpitations, tight chest, short breath, depression, chills, cold extremities, sadness, irritation and irritability, spontaneous sweating, coughs, asthma, insomnia and red-eyed insomnia, nightmares, inflammation and pain, leg pain, dark urine, low appetite, abdominal pains, flatulence, diarrhea, depression, nausea, vomiting, severe weight loss, abdominal distension, and fatigue.

In one embodiment, the time of use of the exogenous energy in a subject may be adjusted according to the subject and/or a condition of the subject. In one embodiment, the time of use of the exogenous energy may be 30 minutes to 3 hours per day for 1 or 2 days up to 30 days, which can be extended according to a subject and/or a condition of a subject. In one embodiment, the time of use of the exogenous energy may be extended to 4 to 6 hours per day. In one embodiment, a subject may use the exogenous energy continuously until and/or after a condition of the subject is alleviated and/or cured. In one embodiment, the time of use of the exogenous energy may be up to 30 weeks.

In one embodiment, the exogenous energy is delivered by the device, the system and/or the method of the present invention according to one or more of the following schemes:

1) delivering via the Huiyin acupoint, the Yongquan acupoint and the Danzhong acupoint for 1 to 3 hours per day for 3 to 30 days for a subject with COVID-19 infection;

2) delivering via the Huiyin acupoint, the Qugu acupoint, the Shenque acupoint, the Yongquan acupoint, the Danzhong acupoint and the Adam's apple for 1 to 3 hours per day for 3 to 30 days to enhance immunity of the subject;

3) delivering via the Xuanzhong acupoint for 1 to 3 hours per day for 3 to 30 days for a subject with neck pain and/or cervical spine disorder;

4) delivering via the Qugu acupoint, the Shenque acupoint and the Yongquan acupoint for 1 to 3 hours per day for 3 to 30 days for a subject with low back pain and/or lumbar spine disorder;
5) delivering via the Yongquan acupoint, the Chengshan acupoint and the Sanyinjiao acupoint for 1 to 3 hours per day for 3 to 30 days for a subject with knee pain;
6) delivering at an area where pain occurs for 1 to 3 hours per day for 3 to 30 days for a subject having pain due to sports and/or injury;
7) delivering via the Huiyin acupoint, the Qugu acupoint and the Yongquan acupoint for 1 to 3 hours per day for 3 to 30 days for a subject with prostate disease;
8) delivering via the Huiyin acupoint, the Qugu acupoint, the Shenque acupoint and the Yongquan acupoint for 1 to 3 hours per day for 3 to 30 days for a subject with gynecological disease;
9) delivering via the Huiyin acupoint, the Qugu acupoint, the Yongquan acupoint and the Sanyinjiao acupoint for 1 to 3 hours per day for 3 to 30 days for a subject with hypertension;
10) delivering via the Huiyin acupoint, the Qugu acupoint, the Yongquan acupoint, the Shenque acupoint and the Sanyinjiao acupoint for 1 to 3 hours per day for 3 to 30 days for a subject with diabetes; and
11) delivering via the Yongquan acupoint, the Danzhong acupoint, the Fengfu acupoint, the Xuanzhong acupoint and the Heart meridian of upper arm inside for 1 to 3 hours per day for 3 to 30 days for a subject with cerebrovascular and/or cardiovascular diseases.

In one embodiment, the device (100) for preventing, alleviating or treating COVID-19 (SARS-CoV-2) coronavirus infection comprises:

a housing (101) comprising a flat bottom and a curved top, wherein the curved top comprises a protruding point (102) in the center; wherein the following are contained in said housing (101):

an elongated energy pin (103);

one or more energy rings (104); and an energy source (105) for generating energy waves, said energy source (105) comprising a front and a back;

wherein said energy source (105) is placed in the center of said flat bottom, wherein one energy ring (104) encircles said energy pin (103), which is placed between said energy source (105) and said protruding point (102), with the longitudinal axes of the one energy ring (104) and the energy pin (103) aligned, wherein one or more therapeutically effective doses of an exogenous energy generated by said device (100) are delivered to one or more body parts of a subject in need thereof, thus preventing, alleviating or treating COVID-19 (SARS-CoV-2) coronavirus infection.

In one embodiment, the front of said energy source (105) emits said energy waves and faces the center of said bottom, or faces said protruding point (102).

In one embodiment, said device (100) is characterized by one or more of the following:

a) said energy pin (103) comprises a flat end and a spherical end, wherein the flat end points towards said energy source (105), and said spherical end is in touch with the protruding point (102);

b) said curved top comprises one or more holes (107) around said energy pin (103);

c) said energy waves have a frequency range of 60 Hz to 300 Hz;

d) said one or more energy rings (104) comprise 80% to 99% by volume of micrite or Rb—Fe—B magnet;

e) said energy pin (103) primarily comprises metal; and f) said housing (101) has one or more sockets on the flat bottom and placed around said energy source (105), each socket accommodating one energy ring (104).

In one embodiment, said device (100) further comprises a storage medium in said housing for storing audio files; said curved top gradually inclines upwards from the edge of the flat bottom towards the center to form said protruding point (102), so that said protruding point (102) can be in touch with a part of the human body where acupoints are located, allowing transmission of energy waves into the body; said energy source (105) is a speaker; said energy waves are sound waves emitting from the front of said speaker (105) facing either the bottom of said housing or said protruding point (102); said energy pin (103) has two ends, with one end flat and attached to said speaker (105), and the other end spherical in shape and in touch with said protruding point (102); and said one or more energy rings (104) reflect said sound waves, causing said sound waves to transmit primarily along the longitudinal axis of said energy ring (104); wherein said device (100) is used for alleviating or treating another condition in said subject.

In one embodiment, the ingredient of said one or more energy rings (104) comprise 80% to 99% by volume of micrite, and one or more of ferrous sulfide, calcium, magnesium, zinc, chromium, antimony, selenium, titanium, manganese, and rare earth elements.

In one embodiment, said micrite has a crystal size of no more than 30 micrometers.

In one embodiment, the length of said housing (101) is 120 to 180 millimeters, the width of said housing (101) is 50 to 100 millimeters, the height of said housing (101) is 20 to 90 millimeters; said protruding point (102) is a spherical cap in shape with a base diameter of 6 to 30 millimeters, a spherical radius of approximately 3.2 to 16 millimeters, and a height of approximately 2.1 to 10.4 millimeters; said one or more energy rings (104) have a height of 4.8 to 7.2 millimeters, a difference between the inner and outer diameters of 4.8 to 7.2 millimeters, and an outer diameter of 16 to 28 millimeters; and the diameter of said energy pin is 4 to 6 millimeters.

In one embodiment, said one or more therapeutically effective doses are 5 to 200 watt hours per day for a treatment period of about 3 days to 90 days.

In one embodiment, a system according to the present invention for preventing, alleviating or treating COVID-19 (SARS-CoV-2) coronavirus infection comprises:

1) a device (100) comprising a housing (101) which comprises a flat bottom and a curved top, wherein the curved top comprises a protruding point (102) in the center; wherein the following are contained in said housing (101):

an elongated energy pin (103);

one or more energy rings (104); and an energy source (105) for generating energy waves, said energy source (105) comprising a front and a back;

wherein said energy source (105) is placed in the center of said flat bottom, wherein one energy ring (104) encircles said energy pin (103), which is placed between said energy source (105) and said protruding point (102), with the longitudinal axes of the one energy ring (104) and the energy pin (103) aligned;

2) a computer processor;

3) one or more data stores storing:

a) audio files, each file characterized by features comprising frequency, amplitude, wavelength, waveform, velocity of wave, and intensity; and b) a relational dataset that correlates one or more of said features to a plurality of conditions; and 4) a computer readable storage medium storing program instructions configured for execution by the computer processor to cause the system to:

a) upon an input of a condition, identify a corresponding audio file among said audio files;

b) retrieve said corresponding audio file from said one or more data stores to said energy source (105) of said device (100); and c) deliver one or more therapeutically effective doses of an exogenous energy generated by said device (100) to one or more body parts of a subject in need thereof, thereby preventing, alleviating or treating COVID-19 (SARS-CoV-2) coronavirus infection.

In one embodiment, a method according to the present invention for preventing, alleviating or treating COVID-19 (SARS-CoV-2) coronavirus infection in a subject in need thereof comprises the steps of:

1) placing a device (100) for acumoxa therapy in close proximity to one or more body parts of said subject, wherein said device (100) comprises a housing (101) comprising a flat bottom and a curved top, wherein the curved top comprises a protruding point (102) in the center; wherein the following are contained in said housing (101):

an elongated energy pin (103);

one or more energy rings (104); and an energy source (105) for generating energy waves, said energy source (105) comprising a front and a back;

wherein said energy source (105) is placed in the center of said flat bottom, wherein one energy ring (104) encircles said energy pin (103), which is placed between said energy source (105) and said protruding point (102), with the longitudinal axes of the one energy ring (104) and the energy pin (103) aligned, and 2) delivering one or more therapeutically effective doses of an exogenous energy generated by said device (100) to said one or more body parts of a subject in need thereof, thereby preventing, alleviating or treating COVID-19 (SARS-CoV-2) coronavirus infection.

In one embodiment, the front of said energy source (105) emits said energy waves and faces the center of said bottom, or faces said protruding point (102).

In one embodiment, said device (100) is characterized by one or more of the following:

a) said energy pin (103) comprises a flat end and a spherical end, wherein the flat end points towards the back or the front of said energy source (105), and said spherical end is in touch with the protruding point (102);

b) said curved top comprises one or more holes (107) around said energy pin (103);

c) said energy waves have a frequency range of 60 Hz to 300 Hz;

d) said one or more energy rings (104) primarily comprise micrite or Rb—Fe—B magnet;

e) said energy pin (103) primarily comprises metal; and f) said housing (101) has one or more sockets on the flat bottom and placed around said energy source (105), each socket accommodating one energy ring (104).

In one embodiment, said device (100) further comprises a storage medium in said housing (101) for storing audio files; said curved top gradually inclines upwards from the edge of the flat bottom towards the center to form said protruding point (102), so that said protruding point (102) can be in touch with a part of the human body where acupoints are located, allowing transmission of energy waves into the body; said energy source (105) is a speaker; said energy waves are sound waves emitting from the front of said speaker (105) facing either the bottom of said housing (101) or said protruding point (102); said energy pin (103) has two ends, with one end flat and attached to said speaker (105), and the other end spherical in shape and in touch with said protruding point (102); and said energy ring (103) reflects said sound waves, causing said sound waves to transmit primarily along the longitudinal axis of said energy ring (104); wherein said device (100) is used for preventing, alleviating or treating COVID-19 (SARS-CoV-2) coronavirus infection.

In one embodiment, the ingredient of said energy ring (104) comprises approximately 80% to 99% by volume of micrite, and one or more of ferrous sulfide, calcium, magnesium, zinc, chromium, antimony, selenium, titanium, manganese, and rare earth elements.

In one embodiment, said micrite has a crystal size of no more than 30 micrometers.

In one embodiment, said one or more body parts comprise the Adam's Apple, the Heart Meridian of Upper Arm Inside, the anus, the pubic bone, the belly button and one or more acupoints of the Huiyin acupoint, the Qugu acupoint, the Shenque acupoint, the Fengfu acupoint, the Yongquan acupoint, the Sanyinjiao acupoint, the Danzhong acupoint, the Xuanzhong acupoint, and the Chengshan acupoint.

In one embodiment, said exogenous energy comprises one or more kinds of energy of the following: 1) said energy waves emitted from said energy source (105) but transmitted to the body via the said energy pin (103); 2) vibrations of said energy pin (103) induced by said energy waves; 3) energy waves reflected by said energy rings (104); 4) secondary energy waves emitted from said energy rings (104) upon stimulation by said energy waves, and 5) energy field of said energy rings (104), thereby harmonically and synergistically maintaining or improving general health, or alleviating or treating said condition.

In one embodiment, said subject has one or more conditions of the following: weakened immune system, neck pain and cervical spine disorder, low back pain and lumber spine disorder, knee pain, pain due to sports and/or injury, prostate diseases, gynecological diseases, hypertension, diabetes, cerebrovascular diseases, cardiovascular diseases, body stress and mental stress, dizziness, heart palpitations, tight chest, short breath, depression, chills, cold extremities, sadness, irritation and irritability, spontaneous sweating, coughs, asthma, insomnia and red-eyed insomnia, nightmares, inflammation and pain, leg pain, dark urine, low appetite, abdominal pains, flatulence, diarrhea, depression, nausea, vomiting, severe weight loss, abdominal distension, and fatigue.

In one embodiment, said one or more therapeutically effective doses are 5 to 200 watt hours per day for a treatment period of about 3 days to 90 days.

In one embodiment, said exogenous energy is delivered according to one or more of the following schemes:

1) delivering via a place in the proximity of anus for a treatment period of about 1 hour to 4 hours per day for about 5 days to about 90 days;

2) delivering, by using two devices (100) and via the Huiyin acupoint and the Danzhong acupoint for a treatment period of about 1 hour to 3 hours per day for about 5 days to about 30 days;

3) delivering, by using two devices (100) and via the Yongquan acupoints on both feet for a treatment period of about 4 hours to 12 hours during night time and about 2 hours to 6 hours during night time hours during day time for about 5 days to about 45 days;

4) delivering, by using two devices (100) and via the pubic bone and the belly button for a treatment period of about 4 hours to 12 hours during night time and about 2 hours to 6 hours during day time for about 5 days to about 45 days;

5) delivering (a) by using four devices (100) and via the pubic bone, the belly button, and both lungs for a treatment period of about 4 hours to 12 hours during day time, and (b) by using four devices (100) and via the pubic bone, the belly button, and the Yongquan acupoints on both feet for a treatment period of 4-12 hours during night time for about 5 days to about 45 days; and 6) delivering (a) by using four devices (100) and via the pubic bone, the belly button, and both lungs for a treatment period of about 1 hour to 4 hours during day time, and (b) by using four devices (100) and via the pubic bone, the belly button, and the Yongquan acupoints on both feet for a treatment period of 4 hours to 12 hours during night time for about 5 days to about 45 days.

In one embodiment, the duration, time and day may be adjusted for each individual as needed. In one embodiment, the energy pin (103) is made of iron and can transmit energy waves emitted from said energy source (105) at a higher speed than that in air. In one embodiment, the energy waves transmitted via the energy pin (103), together with the energy waves transmitted via air, can maintain or improve general health, or alleviate or treat diseases and/or conditions as disclosed in the present invention, such as relaxing the body and mind and relieving pain.

In one embodiment, stimulation by the energy waves emitted from said energy source (105) or any other energy input can generate vibration in the energy pin (103). The vibration may transmit via the energy pin (103) to the protruding point (102) and further into a human body, which may improve the therapeutic effect to the target organs or areas of the body, e.g., relaxing the body and mind and/or relieving pain. In one embodiment, the energy pin (103) may resonate when the driving frequency of the energy waves (e.g., sound waves) matches or is close to the natural frequency of the energy pin (103).

In one embodiment, the energy rings (104) are made of microcrystalline calcite (micrite) or Rb—Fe—B magnets. In one embodiment, the microcrystalline calcite (micrite) has a crystal size of no more than 30 micrometers. In one embodiment, the microcrystalline calcite has a crystal size of 1 to 30 micrometers. In one embodiment, the energy rings (104) can reflect the energy waves with little or minimum absorption so as to maximize delivery of the energy waves into the body, target organs or areas of the body. The reflection of the energy waves (e.g., sound waves) by the energy rings (104) effectively focuses and/or modulates the transmission of the energy waves (e.g., sound waves) along the central axis of the energy rings (104). In one embodiment, the focused/modulated transmission of the energy waves is primarily along the central axis of the energy rings (104) towards the top and the body of the housing (101) of the device (100), maximizing therapeutic effects of said device (100). In one embodiment, stimulation by the energy waves or any other energy input may cause the energy rings (104) to emit secondary energy waves with unique properties. Energy rings (104) made of different materials may emitted different kinds of secondary energy waves. In one embodiment, the energy waves emitted from the energy source (105) and the secondary energy waves emitted from the energy rings (104) are different in terms of frequency, amplitude, waveforms, etc. In one embodiment, the energy waves emitted from the energy source (105) are sound waves. In one embodiment, the secondary energy waves emitted from the energy rings (104) are acoustic waves, infrasonic waves, and/or ultrasonic waves. In one embodiment, the secondary energy waves emitted from the energy rings (104) have a frequency of 20 to 2000 kHz. In one embodiment, the energy waves emitted from the energy source (105) and the secondary energy waves emitted from the energy rings (104) function harmonically and synergistically to relax the body and mind and/or relieve pain.

In one embodiment, the energy rings (104) are made of stones/magnets capable of emitting energy and/or generating an energy field. In one embodiment, the existence of such energy or energy field can be sensed or experienced by a user of the device (100) or a subject in treatment. In one embodiment, the existence of such energy or energy field can be sensed or detected by a human with or without a wave detector or an energy field detector.

In one embodiment, use of the device (100) effectively reduces the hypertension syndrome in a subject with systolic blood pressure up to 200 mmHg After daily use of 1 to 6 hours for a continuous 3 to 30 days, the subject's systolic blood pressure is lowered to 140 to 150 mmHg. In one embodiment, use of the device (100) effectively reduces the diastolic blood pressure in one subject. After daily use of 1 to 3 hours for a continuous 30 days, the subject's diastolic blood pressure is lowered from 100 mmHg to 80 mmHg.

In one embodiment, use of the device (100) effectively relieves pain in a subject. On levels 0 to 10 in Michigan Pain Measurement Scales (MPMS), the subject's pain level is reduced from level 10 to level 7 after using the device (100) for 30 minutes to 3 hours, and the pain is mostly relieved after 30 days of use (about 3 hours per day).

In one embodiment, use of the device (100) effectively relieves pain in a subject. On levels 0 to 10 in Michigan Pain Measurement Scales (MPMS), the subject's pain level is reduced from level 7 to level 3 after using the device (100) for 30 minutes to 3 hours, and the pain is mostly relieved after 30 days of use (about 3 hours per day).

In one embodiment, said energy waves are sound waves comprising the "Fire Sound" according to traditional Chinese musicology and are associated with healing function for heart diseases. The "Fire Sound" waves are best applied between 11 AM and 1 PM during the day to cure the heart and small intestine. In one embodiment, daily use of 3 hours of the device (100) with the "Fire Sound" for a continuous 30 days can effectively boost blood circulation, nourish muscles, and alleviate other symptoms including dizziness, heart palpitations, tight chest, short breath, depression, and chills and cold extremities.

In one embodiment, said energy waves are sound waves comprising the "Wood Sound" according to traditional Chinese musicology and are associated with healing function for liver diseases. The "Wood Sound" waves are best applied between 11 PM and 1 AM during the night, or any time during the day and night, to cure the liver and the gall bladder. In one embodiment, daily use of 3 hours of the device (100) with the "Wood Sound" for a continuous 30 days can effectively alleviate symptoms including low appetite, abdominal pains, flatulence, diarrhea, depression and irritation.

In one embodiment, said energy waves are sound waves comprising the "Earth Sound" according to traditional Chinese musicology and are associated with healing function for spleen-related symptoms. The "Earth Sound" waves are best applied between 9 and 11 AM during the day to cure the spleen and the stomach. In one embodiment, daily use of 3 hours of the device (100) with the "Earth Sound" for a continuous 30 days can effectively alleviate symptoms including nausea, diarrhea, vomiting, weight loss, abdominal distension, fatigued, and insomnia.

In one embodiment, said energy waves are sound waves comprising the "Metal Sound" according to traditional Chinese musicology and are associated with healing function for lung diseases. The "Metal Sound" waves are best applied between 3 and 5 AM to cure the lung and the large intestine. In one embodiment, daily use of 3 hours of the device (100) with the "Metal Sound" for a continuous 30 days can effectively alleviate symptoms including sadness, irritability, spontaneous sweating, coughs, and asthma.

In one embodiment, said energy waves are sound waves comprising the "Water Sound" according to traditional Chinese musicology and are associated with healing function for kidney diseases. The "Water Sound" waves are best applied between 5 and 7 PM to cure the kidney and the bladder. In one embodiment, daily use of 3 hours of the device (100) with the "Water Sound" for a continuous 30 days can effectively alleviate symptoms including red-eyed insomnia, nightmares, inflammation and pain, leg pain, and dark urine.

In one embodiment, said "Fire Sound" can be applied to healing pain across the human body. In one embodiment, said "Water Sound" can be applied to improving the quality of sleep.

In one embodiment, besides energy of sound waves, the energy waves may be produced by other types of energy including heat or thermal energy, electrical energy, and solar or light energy.

In one embodiment, disease and symptoms in Table 2 are alleviated and/or cured by applying the device (100) with listed sound wave energy at the listed acupoint for the listed time duration.

TABLE 2

Indications and Treatment by Energy Waves

| Indication | Acupoint | Duration of Use | Energy Wave |
|---|---|---|---|
| dizziness, heart palpitations, tight chest, short breath, depression, and chills and cold extremities; sadness, irritability, spontaneous sweating, coughs, and asthma | Danzhong Acupoint | 30 minutes to 3 hours | The "Fire Sound" and/or the pithy formula for heart therapy; the "Metal Sound" and/or the pithy formula for lung therapy |
| red-eyed insomnia, nightmares, inflammation and pain, leg pain, and dark urine | Yongquan Acupoint | 30 minutes to 3 hours | The "Water Sound" and/or the pithy formula for kidney therapy |
| low appetite, abdominal pains, flatulence, diarrhea, depression and irritation | Qugu Acupoint | 30 minutes to 3 hours | The "Wood sound" and/or the pithy formula for liver therapy |
| nausea, diarrhea, vomiting, weight loss, abdominal distension, fatigued, and insomnia | Shenque Acupoint | 30 minutes to 3 hours | The "Earth Sound" and/or the pithy formula for spleen therapy |

In one embodiment, disease and symptoms in Table 3 are alleviated, improved and/or cured by applying the device (100) with listed sound wave energy at the listed acupoints for the listed time duration. Several devices (100) of the present invention can be applied to the listed acupoints at the same time. When using the device (100) at the listed acupoints sequentially, best effects can be achieved if the listed order is followed. However, the order of application is not a prerequisite for achieving desired effects.

TABLE 3

Indications and Treatment by Energy Waves

| Use/Treatment | Acupoints | Duration of Use | Energy Wave |
|---|---|---|---|
| Alleviate, improve and/or cure syndromes of COVID-19 | Huiyin acupoint, Yongquan acupoint | 3 hours if applied simultaneously; at least 1 hour for each acupoint if applied sequentially. | The "Water Sound" and/or the pithy formula for kidney therapy |
| | Danzhong acupoint | 3 hours | The "Metal Sound" and/or the pithy formula for lung therapy |
| Enhance immunity | Huiyin acupoint, Qugu acupoint, Shenque acupoint, Yongquan acupoint | 3 hours if applied simultaneously; at least 1 hour for each acupoint if applied sequentially. | The "Metal Sound" and/or pithy formula for lung therapy |
| | Danzhong acupoint, Adam's Apple | 3 hours if applied simultaneously; at least 1 hour for each acupoint if applied sequentially. | The "Metal Sound" and/or the pithy formula for lung therapy |

TABLE 3-continued

| Indications and Treatment by Energy Waves | | | |
|---|---|---|---|
| Use/Treatment | Acupoints | Duration of Use | Energy Wave |
| Alleviate, improve and/or cure neck pain and cervical spine disorder | Xuanzhong acupoint | 3 hours | Pithy formula for relieving and/or treating pain |
| Alleviate, improve and/or cure low back pain and lumbar spine disorder | Qugu acupoint, Shenque acupoint, Yongquan acupoint | 3 hours if applied simultaneously; at least 1 hour for each acupoint if applied sequentially. | Pithy formula for relieving and/or treating pain |
| Alleviate, improve and/or cure knee pain | Yongquan acupoint, Chengshan acupoint, | 3 hours if applied simultaneously; at least 1 hour for each acupoint if applied sequentially. | The "Water Sound" and/or the pithy formula for kidney therapy |
| | Sanyinjiao acupoint | 3 hours | The "Earth Sound" and/or the pithy formula for spleen therapy |
| Alleviate, improve and/or cure pain due to sports and injury | Areas of the body when pain occurs | 3 hours | Pithy formula for relieving and/or treating pain |
| Alleviate, improve and/or cure prostate diseases | Huiyin acupoint, Qugu acupoint, Yongquan acupoint | 3 hours if applied simultaneously; at least 1 hour for each acupoint if applied sequentially. | The "Water Sound" and/or the pithy formula for kidney therapy |
| Alleviate, improve and/or cure gynecological diseases | Huiyin acupoint, Qugu acupoint, Shenque acupoint, Yongquan acupoint | 3 hours if applied simultaneously; at least 1 hour for each acupoint if applied sequentially. | The "Water Sound" and/or the pithy formula for kidney therapy |
| Alleviate, improve and/or cure hypertension | Huiyin acupoint, Qugu acupoint, Yongquan acupoint | 3 hours if applied simultaneously; at least 1 hour for each acupoint if applied sequentially. | The "Water Sound" and/or the pithy formula for kidney therapy |
| | Sanyinjiao acupoint | 3 hours | The "Earth Sound" and/or the pithy formula for spleen therapy |
| Alleviate, improve and/or cure diabetes | Huiyin acupoint, Qugu acupoint, Yongquan acupoint | 3 hours if applied simultaneously; at least 1 hour for each acupoint if applied sequentially. | The "Water Sound" and/or the pithy formula for kidney therapy |
| | Shenque acupoint, Sanyinjiao acupoint | 3 hours if applied simultaneously; at least 1 hour for each acupoint if applied sequentially. | The "Earth Sound" and/or the pithy formula for spleen therapy |
| Alleviate, improve and/or cure cerebrovascular and cardiovascular diseases | Yongquan acupoint | 3 hours | The "Water Sound" and/or the pithy formula for kidney therapy |
| | Danzhong acupoint | 3 hours | The "Metal Sound" and/or the pithy formula for lung therapy |
| | Fengfu acupoint, Xuanzhong acupoint | 3 hours if applied simultaneously; at least 1 hour for each acupoint if applied sequentially. | The "Wood sound" and/or the pithy formula for liver therapy |
| | Heart meridian of upper arm inside | 3 hours | The "Fire Sound" and/or the pithy formula for heart therapy |

In one embodiment, disease and symptoms in Table 4 are alleviated, improved and/or cured after, via the energy source (105) of the device (100), delivering or administering the listed sound waves to a subject in need for the listed time duration. In one embodiment, the energy source (105) can be in a form of headphone, earphone, speakers (105), and other audio apparatus. In one embodiment, the energy source (105) can be connected to, or operable with a computer, a mobile device (100) such as a smartphone or a table computer, or a server.

TABLE 4

Indications and Treatment by Energy Waves

| Use/Treatment | Duration of Listening | Energy Wave |
|---|---|---|
| Alleviate, improve and/or cure syndromes of COVID-19 | 30 minutes to 3 hours | The "Water Sound" and/or the pithy formula for kidney therapy |
| Enhance immunity | 30 minutes to 3 hours | The "Water Sound" and/or the pithy formula for kidney therapy |
| Relax body and mind; alleviate and/or relieve stress | 30 minutes to 3 hours | Pithy formula for relaxing and relieving stress |
| Improve quality of sleep | 30 minutes to 3 hours | Pithy formula for relaxing and relieving stress |
| Alleviate, improve and/or cure hypertension | 30 minutes to 3 hours | The "Water Sound" and/or the pithy formula for kidney therapy |
| Alleviate, improve and/or cure cerebrovascular and cardiovascular diseases | 30 minutes to 3 hours | The "Water Sound" and/or the pithy formula for kidney therapy |

The device (100) of the present invention provides non-invasive diagnosis and therapy that is convenient, safe and effective on preventing and/or treating various diseases and symptom, including the COVID-19 syndrome. In one embodiment, in preventing and treating the COVID-19 syndrome, the device (100) as disclosed and described in the present invention has the following advantages:

1. Online analysis and treatment: a user or patient does not need to go to a clinic site. Upon entry of the symptoms and/or any discomfort online, an analysis and a solution for prevention and treatment can be provided online. The solution comprises intelligently selected energy waves and smartly tuned intensity and time duration of the energy waves that the user or the patient may adopt at home by using the device (100) of the present invention, on a computer or a mobile device (100) such as a smartphone or a tablet computer. The website is online 24 hours a day to provide all day service to users and patients.

2. Convenience: a user or patient may easily download therapeutic waves onto the device (100) of the present invention, a computer or a mobile device (100). The user or the patient may wear the device (100) of the present invention using an accessory such as a bag with ropes on two sides.

3. Safety: the treatment by therapeutic waves is non-invasive, and the energy waves (e.g., sound waves) are safe to human-beings without any known side-effects.

4. Effectiveness: The novel coronavirus basically invades human lungs through the nasal cavity, and then affects other organs.

In one embodiment, the present invention discloses a device (100) and a method for preventing and/or treating the COVID-19 syndromes by: 1) improving the function of lungs and a patient's immunity, alleviating chronic symptoms, and effectively preventing and limiting the coronavirus infection; and 2) restoring and enhancing the detoxification function of the large intestine organs. Once the detoxification function is restored and enhanced, the vital capacity can also be enlarged.

The "Five Sounds" therapy furnished by the present invention is to prevent and cure diseases through physical and psychological influence of a human's body. The frequency and rhythm of the energy waves (e.g., sound waves) carry physical energy and cause physiological reactions. Components in the device (100) of the present invention further moderate the physical energy to cause harmonic resonance in human cells and tissues in the cranial cavity, chest cavity, abdominal cavity or certain other tissues. The resonance caused by such energy waves will directly affect a human's brainwaves, heart rate, breathing rhythm, and other measurable physiological parameters. When transmitted into a human's body and/or heard by a human's ear, the "Metal Sound" and/or the pithy formula for lung therapy can stimulate and/or booster a human's central nervous system and endocrine system. In terms of modern immunology, treatment by the device (100) of the present invention will increase the quantity and concentration of IgA, which not only improves the systemic immunity, but also improves the local immunity (e.g., mucosa), and thus plays an important role in the body functions of antibacterial, antiviral and antiinfection. In one embodiment, the device (100) of the present invention is a wearable medical equipment and can be placed at the Huiyin acupoint in proximity of the human anus, and by transmitting the sound waves (e.g., the "Earth Sound" and/or the pithy formula for spleen therapy treating the large intestine), resonance is generated at the anus. The resonance can increase the peristalsis of the anus and the large intestine and enhance the body's detoxification function, which further enhances the body's immunity against viruses including the novel coronavirus.

The present invention will be better understood by reference to the examples as follows, but those skilled in the art will readily appreciate that the specific examples detailed are only for illustrative purpose, and are not meant to limit the present invention as described herein, which is defined by the claims following thereafter.

Throughout this application, various references or publications are cited. Disclosures of these references or publications in their entireties are hereby incorporated by reference into the application in order to more fully describe the state of the art to which this invention pertains. It is to be noted that the transitional term "comprising", which is synonymous with "including", "containing" or "characterized by", is inclusive or open-ended, and does not exclude additional, un-recited elements or method steps.

Example 1

The device (100) of the present invention can be applied to various parts of a human body. For example, it can be applied to the following important acupoints of the human body (including method of use):

1. The Huiyin acupoint: users may sit directly on the top of the housing (101) and have the protruding point (102) contact the Huiyin acupoint close to the human pelvis. The protruding point (102) is configured to be able to touch the Huiyin acupoint and produces the effects of acumoxa therapy. The Huiyin acupoint is located at the perineum of the body as an intersection of three meridians, i.e., the Ren Meridian, the Du Meridian and the Zhong Meridian, which all pass through the Baihui acupoint at the top of the head. The Huiyin acupoint is an important acupoint of meridian relating to human longevity, is the pathway of vital energy of a human, and is one of the acupoints that cannot be neglected for daily health care. The device (100) transfers the energy waves of pithy formulas, i.e., MEWs into the Huiyin acupoint via the protruding point (102) and further to various parts of the body. Because the Huiyin acupoint is next to the pubic symphysis, and because the top of the housing (101) is configured to match the shape of the ischium, the energy waves of the pithy formulas induce vibrations of the ischium, which are then transmitted within the body;

2. The Qugu acupoint: users may stand, sit or lie down when using the device (100) of the present invention which is loaded in a bag and use the ropes on the two sides of the bag to secure the device (100) onto the body, having the bottom of the housing (101) contact the Qugu acupoint for the benefits of moxibustion therapy;

3. The Shenque acupoint: users may stand, sit down or lie down when using the device (100) of the present invention which is loaded in a bag and use the ropes on the two sides of the bag to secure the device (100) onto the body, having the protruding point (102) contact the Shenque acupoint. The protruding point (102) is configured to be able to touch the Shenque acupoint and produces the effects of acumoxa therapy. The Shenque acupoint is on the Ren Meridian and related to the vital energy and physical strength of a human, strength of waist muscles, tone of facial skin, senses of sight and hearing, weight control and longevity. The Shenque acupoint is near the navel and cannot be treated using traditional acupuncture therapy. The device (100) of the present invention is non-invasive and avoids the disadvantages of traditional acumoxa therapy;

4. The Fengfu acupoint: users may stand, sit down or lie down when using the device (100) of the present invention which is loaded in a bag and use the ropes on the two sides of the bag to secure the device (100) onto the body, having the bottom of the housing (101) contact the Fengfu acupoint for benefits of moxibustion therapy; and 5. The Yongquan acupoint: users may sit or lie down and place the device (100) of the present invention under a foot so that the protruding point (102) makes contact with the Yongquan acupoint for the effects of acumoxa therapy.

Example 2

In actual use, the device (100) of the present invention produces the following effects:

1. Relax the body and mind. Number of reported effectiveness: 100 cases. Effectiveness rate: 96%.

2. Relieve and treat various kinds of pains and discomfort, such as cervical pain, lumbar pain, knee pain, pain due to sports injury, and so on. Number of reported effectiveness: 67 cases. Effectiveness rate: 90%. For example, for patients with toe pain due to sports injuries, 30% were relieved after continuous use of the device (100) of the present invention for 30 minutes, 50% were relieved after 5 hours of cumulative use (2.5 hours a day for 2 days), 70% were relieved after 24 hours of cumulative use (3 hours a day for 8 days), and 90% were relieved after 48 hours of cumulative use (3 hours a day for 16 days).

3. Achieve anti-aging effect via facial skin rejuvenation, removal of uneven facial skin tone and reduction of swelling in the face.

4. Relieve physical discomfort caused by prostate diseases (such as benign prostatic hyperplasia, prostate cancer, etc.), e.g., reduce the number of nocturia episodes.

5. Relieve physical discomfort after gynecological surgeries, such as numbness of the abdomen after uterine cancer surgery.

Example 3

In this example, the device (100) of the present invention was used by healthy subjects to prevent COVID-19 (SARS-CoV-2) coronavirus infection. The device (100) was placed in close proximity to anus for a treatment period of 1-4 hours per day to improve the immune functions of lung. The device (100) was used by 90 healthy subjects. Based on tests of the subjects' immunoglobulin level and body strength, and by traditional Chinese medical diagnosis (e.g., telediagnosis of subjects' eyes, ears, tongue, nose, complexion, body posture and bone structure), around 70% of the subjects received an improved lung immunity after a treatment for 5 days to 30 days with a dose of energy of 5 to 60 watt hours. After the device was placed in close proximity to anus for a treatment period of 1-4 hours per day for about 30 days to 90 days with a dose of energy of 5 to 300 watt hours, ~90% of the subjects received an improved lung immunity. With improved lung immunity, these healthy subjects' risk of infection by COVID-19 was lowered.

Example 4

In this example, the device (100) of the present invention was used to treat asymptomatic coronavirus carriers. The device (100) was used by 20 subjects who were asymptomatic coronavirus carriers. Each subject uses two devices (100) at the same time. One device (100) was placed in close proximity to anus, and a second device (100) was placed in close proximity to the Danzhong acupoint. The treatment period lasted 1-3 hours per day for about 5 days to 30 days with a dose of energy of 5 to 300 watt hours. Based on tests of the subjects' immunoglobulin level, cold symptoms and body strength, and by traditional Chinese medical diagnosis (e.g., telediagnosis of subjects' eyes, ears, tongue, nose, complexion, body posture and bone structure), a treatment for 10 days with a dose of energy of 5 to 200 watt hours was effective in improving the immune functions of the lungs and preventing COVID-19 symptoms in about 90% of the subjects who showed no symptoms related to COVID-19 after 30 days of testing positive.

Example 5

In this example, the device (100) of the present invention was used to treat subjects with obvious symptoms. 20 subjects were treated, and each subject used two devices (100) at the same time. For subjects having symptoms of fever, muscle weakness and/or pains, body pains and nausea, two devices (100) were placed at the Yongquan acupoints on the bottom of two feet, respectively. For subjects having symptoms of cold, cough, stuffy nose, sore throat, chest tightness, shortness of breath, difficulty in breath, and headache, one device (100) was placed in close proximity to the pubic bone, and a second device (100) was placed in the close proximity of the navel. Every day the subjects used the device for 4-12 hours at night and 2-6 hours during the day. After applying two devices (100) for 1-5 days with a dose of energy of 5 to 100 watt hours, symptoms of cold, muscle weakness and fever are alleviated, and 80% of the subjects fully recover from these symptoms after a treatment for 5 to 10 days with a dose of energy of 5 to 200 watt hours. For other symptoms as mentioned above, 75% of the subjects report alleviation after treatment for 5 to 10 days, and 90% of the subjects are fully recovered after treatment for 1 to 3 weeks with a dose of energy of 100 to 600 watt hours. In one case, for one subject with fever, muscle or body aches, and nausea, two devices were applied to the Yongquan acupoints on both feet for 4-12 hours at night and 2-6 hours during day time. After a treatment for 10 days, the subject was recovered from the COVID-19 infection.

Example 6

In this example, two devices (100) of the present invention was used to treat subjects with severe COVID-19 symptoms. A set of COVID-19 positive subjects have the following symptoms: cough, stuffy nose, sore throat, chest tightness, shortness of breath, difficulty in breathing, and headache. One device was placed in close proximity to pubic bone of the subject, and a second device was placed in close proximity to belly button. After applying two devices (100) for a treatment period of 4-10 hours at night and 2-6 hours during day time for about 5 to 45 days with a dose of energy of 5 to 800 watt hours, the symptoms in around 60% to 90% of the subjects were partially or fully alleviated. Higher dose of energy is correlated with more subjects partially or fully alleviating.

Example 7

In this example, multiple devices (100) of the present invention are used to treat COVID-19 positive subjects in critical conditions. 7 subjects were treated, with each subject using 4 devices (100) at the same time. The subjects all had symptoms of difficulty in breathing, high fever, full body pain, high blood pressure. During day time, one device was placed in close proximity to belly button, a second device was placed in close proximity to pubic bone, and a third and a fourth devices were placed on the chest in close proximity to both lungs. At night, the first and the second devices stay unchanged, and the third and fourth devices were moved to the Yongquan acupoints on the bottom of feet, respectively. The daytime treatment lasted for 4-12 hours per day, and the treatment at night lasted for 4-12 hours per day. After a first treatment for 1-3 days, the above-mentioned symptoms were alleviated, especially the difficulty in breathing and the full body pain. After a treatment for 1-3 days, high fever was alleviated and/or recovered. After a treatment for 5-15 days, 60% to 90% of the subjects were effectively recovered from all symptoms.

Example 8

In this example, two devices (100) of the present invention are used to help subjects to maintain health after recovering from COVID-19 infection and/or symptoms Immunity level of 25 subjects' lungs was tested normal after their recovery from COVID-19 infection and/or symptoms. Each subject used the two devices (100). One device was placed in close proximity to belly button, and a second device was placed in close proximity to pubic bone. The daytime treatment lasted for 1-4 hours per day, and the treatment at night lasted for 4-12 hours per day. Based on tests of the subjects' immunoglobulin level, after a treatment for 5-10 days with a dose of energy of 5 to 200 watt hours, 60% to 90% of the subjects' lung immunity was maintained at the normal level, so that reinfection of COVID-19 (SARS-CoV-2) coronavirus was lowered.

REFERENCES

1. Online materials available on https://www.taiyi-institute.com/.

2. Wikipedia page on "Chinese musicology" teaching the "Fire Sound", the "Wood Sound", the "Metal Sound", the "Earth Sound" and the "Water Sound". See https://en.wikipedia.org/wiki/Chinese_musicology.

3. Wikipedia page on "Wuxing (Chinese philosophy)" teaching the five elements, i.e., the Fire, the Wood, the Water, the Metal and the Earth. See https://en.wikipedia.org/wiki/Wuxing_(Chinese_philosophy).

4. Zohuri et al. *Electrical Brain Stimulation for the Treatment of Neurological Disorders*. Apple Academic Press (2019).

5. Boyd-Brewer et al. *Vibroacoustic Sound Therapy Improves Pain Management and More*. Holistic Nursing Practice. Vol. 18, Issue 3, pg. 111-8 (2004).

6. Lawrence Leung. *Traditional Chinese Medicine—a beginner's guide*. InnovAiT. Vol. 4, Issue 1, Pages 49-54, November 2010.

7. Peter Deadman, et al. *A Manual of Acupuncture*. Journal of Chinese Medicine Publications; 2nd Edition. Jun. 25, 2007.

What is claimed is:

1. A device for preventing, alleviating or treating COVID-19 (SARS-CoV-2) coronavirus infection, said device comprising:

a housing comprising a flat bottom and a curved top, wherein the curved top comprises a center and a protruding point in the center of the curved top, and the flat bottom comprises a center, wherein the following are contained in said housing:

an elongated energy pin with a longitudinal axis;

one or more energy rings, each having a longitudinal axis; and a speaker as an energy source for generating energy waves, said speaker comprising a front and a back, wherein said speaker is placed in the center of said flat bottom, wherein one energy ring of said one or more energy rings encircles said energy pin, which is placed between said speaker and said protruding point, with the longitudinal axes of said one or more energy rings and the energy pin aligned, wherein the curved top gradually inclines upwards from an edge of the flat bottom towards the center of the curved top to form the protruding point, so that, the protruding point in use is in touch with a part of a human body of a subject where acupoints are located, allowing transmission of energy waves into the human body;

wherein said energy waves are sound waves emitting from the front of said speaker facing either the bottom of said housing or said protruding point; said energy pin also having two ends, with one end is flat and attached to the speaker, and another end is spherical in shape and is in touch with the protruding point; and said one or more energy rings reflect said sound waves, causing said sound waves to transmit primarily along the longitudinal axis of said energy ring;

wherein said device delivers one or more doses of the sound waves to one or more parts of the human body of the subject, thus preventing, alleviating or treating COVID-19 (SARS-CoV-2) coronavirus infection in the subject.

2. The device of claim 1, wherein said device further comprises a storage medium for storing audio files, and the front of said speaker emits said energy waves and faces the center of said flat bottom, or faces said protruding point.

3. The device of claim 1, wherein the device is characterized by one or more of the following:

a) said curved top comprises one or more holes around said energy pin;

b) said energy waves have a frequency range of 60 Hz to 300 Hz;

c) said one or more energy rings comprise 80% to 99% by volume of micrite or Rb-Fe-B magnet;

d) said energy pin primarily comprises metal; and e) said housing has one or more sockets on the flat bottom and placed around said speaker, each socket accommodating one energy ring.

4. The device of claim 1, wherein the one or more energy rings comprise 80% to 99% of micrite by volume, and one or more of ferrous sulfide, calcium, magnesium, zinc, chromium, antimony, selenium, titanium, manganese, and rare earth elements.

5. The device of claim 1, wherein said one or more energy rings comprise a micrite having a crystal size of no more than 30 micrometers.

6. The device of claim 1, wherein the housing has a length of 120 to 180 millimeters, a width of 50 to 100 millimeters, and a height of 20 to 90 millimeters; said protruding point is a spherical cap in shape and has a base diameter of 6 to 30 millimeters, a spherical radius of approximately 3.2 to 16 millimeters, and a height of approximately 2.1 to 10.4 millimeters; each of the one or more energy rings has a height approximately 4.8 to 7.2 millimeters, an outer diameter of approximately 16 to 28 millimeters; and a base diameter of approximately 4 to 6 millimeters; each of the one or more energy rings has an inner radius and an outer radius, and has a difference between the inner radius and the outer radius of approximately 4.8 to 7.2 millimeters.

7. The device of claim 1, wherein said one or more doses are 5 to 200 watt hours per day for a period of 3 to 90 days.

8. A system for preventing, alleviating or treating COVID-19 (SARS-CoV-2) coronavirus infection, said system comprising:

i) a device comprising a housing comprising a flat bottom and a curved top, wherein the curved top comprises a center and a protruding point in the center of the curved top, and the flat bottom comprises a center, wherein the following are contained in said housing:

an elongated energy pin with a longitudinal axis;

one or more energy rings, each having a longitudinal axis;

a speaker as an energy source for generating energy waves, said speaker comprising a front and a back; and a storage medium for storing audio files, wherein said speaker is placed in the center of said flat bottom, wherein one energy ring of said one or more energy rings encircles said energy pin, which is placed between said speaker and said protruding point, with the longitudinal axes of said one or more energy rings and the energy pin aligned, wherein the curved top gradually inclines upwards from an edge of the flat bottom towards the center of the curved top to form the protruding point, so that, the protruding point in use is in touch with a part of a human body where acupoints are located, allowing transmission of energy waves into the human body;

wherein said energy waves are sound waves emitting from the front of said speaker facing either the bottom of said housing or said protruding point; said energy pin also having two ends, with one end is flat and attached to the speaker, and another end is spherical in shape and is in touch with the protruding point; and said one or more energy rings reflect said sound waves, causing said sound waves to transmit primarily along the longitudinal axis of said energy ring;

ii) a computer processor;

iii) one or more data stores storing:

a) said audio files, each file characterized by features comprising frequency, amplitude, wavelength, waveform, velocity of wave, and intensity; and b) a relational dataset that correlates one or more of said features to a plurality of conditions; and iv) a computer readable storage medium storing program instructions configured for execution by the computer processor to cause the system to:

a) upon an input of a condition among the plurality of conditions, identify a corresponding audio file among said audio files;

b) retrieve said corresponding audio file from said one or more data stores to the speaker of the device; and c) deliver one or more doses of the sound waves generated by the speaker to one or more parts of the human body of a subject in need thereof, said one or more doses ranging from 5 to 200 watt hours per day for a period of 3 to 90 days, thereby preventing, alleviating or treating COVID-19 (SARS-CoV-2) coronavirus infection in said subject.

9. A method for preventing, alleviating or treating COVID-19 (SARS-CoV-2) coronavirus infection in a subject in need thereof, said method comprising the steps of:

i) placing a device for acumoxa therapy in close proximity to one or more parts of a human body of the subject, wherein the device comprises a housing comprising a flat bottom and a curved top, wherein the curved top comprises a center and a protruding point in the center of the curved top, and the flat bottom comprises a center, wherein the following are contained in said housing:

an elongated energy pin with a longitudinal axis;

one or more energy rings, each having a longitudinal axis; and a speaker as an energy source for generating energy waves, said speaker comprising a front and a back, wherein said speaker is placed in the center of said flat bottom, wherein one energy ring of said one or more energy rings encircles said energy pin, which is placed between said speaker and said protruding point, with the longitudinal axes of said one or more energy rings and the energy pin aligned, wherein the curved top gradually inclines upwards from an edge of the flat bottom towards the center of the curved top to form the protruding point, so that, the protruding point in use is in touch with a part of a human body where acupoints are located, allowing transmission of energy waves into the human body;

wherein said energy waves are sound waves emitting from the front of said speaker facing either the bottom of said housing or said protruding point; said energy pin also having two ends, with one end is flat and attached to the speaker, and another end is spherical in shape and is in touch with the protruding point; and said one or more energy rings reflect said sound waves, causing said sound waves to transmit primarily along the longitudinal axis of said energy ring; and ii) delivering one or more doses of the sound waves generated by the speaker to one or more parts of the human body of the subject, said one or more doses ranging from 5 to 200 watt hours per day for a period of 3 to 90 days, thereby preventing, alleviating or treating COVID-19 (SARS-CoV-2) coronavirus infection in said subject.

10. The method of claim 9, wherein said device further comprises a storage medium for storing audio files, and the front of said speaker emits said energy waves and faces the center of said bottom, or faces said protruding point.

11. The method of claim 9, wherein said device is characterized by one or more of the following:

a) said curved top comprises one or more holes around said energy pin;

b) said energy waves have a frequency range of 60 Hz to 300 Hz;

c) said one or more energy rings primarily comprise micrite or Rb-Fe-B magnet;

d) said energy pin primarily comprises metal; and e) said housing has one or more sockets on the flat bottom and placed around said speaker, each socket accommodating one energy ring.

12. The method of claim 9, wherein the one or more energy rings comprise 80% to 99% of micrite by volume, and one or more of ferrous sulfide, calcium, magnesium, zinc, chromium, antimony, selenium, titanium, manganese, and rare earth elements.

13. The method of claim 9, wherein the one or more energy rings comprise a micrite with a crystal size of no more than 30 micrometers.

14. The method of claim 9, wherein the one or more parts of the human body comprise Adam's Apple, Heart Meridian of Upper Arm Inside, anus, pubic bone, belly button and one or more acupoints of Huiyin acupoint, Qugu acupoint, Shenque acupoint, Fengfu acupoint, Yongquan acupoint, Sanyinjiao acupoint, Danzhong acupoint, Xuanzhong acupoint, and Chengshan acupoint, wherein said Heart Meridian of Upper Arm Inside flows along midline of inside upper arm, through inner elbow, along midline of inner lower arm, until it crosses wrist and palm, before ending in inside tip of little finger of the human body;

wherein said Huiyin acupoint is located at perineum, midway between the anus and scrotum in men, or midway between the anus and posterior labial commissure in women;

where said Qugu acupoint is located on midline of lower abdomen, at superior border of pubic symphysis, and 6.6 inches below umbilicus of the human body;

wherein said Shenque acupoint is located at the belly button in center of umbilicus of the human body;

wherein said Fengfu acupoint is located on midline at nape of neck, in a depression immediately below external occipital protuberance of the human body;

wherein said Yongquan acupoint is located on sole of a foot, between the second and third metatarsal bones, one third of distance between base of the second toe and heel of the human body, and in a depression formed when the foot is plantar flexed;

wherein said Sanyinjiao acupoint is located on medial side of lower leg, 3.9 inches above prominence of medial malleolus, and in a depression close to medial crest of tibia of the human body;

wherein said Danzhong acupoint is located on midline of sternum and in a depression level with junction of the fourth intercostal space and sternum of the human body;

wherein said Xuanzhong acupoint is located above ankle joint, 3.9 inches above prominence of lateral malleolus, and between posterior border of fibula and tendons of peroneus longus and *brevis* of the human body;

wherein said Chengshan acupoint is located on lower leg, in a depression formed below bellies of gastrocnemius muscle when the gastrocnemius muscle is flexed, and midway between popliteal fossa and ankle joint of the human body.

15. The method of claim 14, wherein the sound wave energy is delivered according to one or more of the following schemes:

i) delivering via anus for a period of 1 hour to 4 hours per day for 5 days to 90 days;

ii) delivering, by using two devices and via the Huiyin acupoint and the Danzhong acupoint for a period of 1 hour to 3 hours per day for 5 days to 30 days;

iii) delivering, by using two devices and via the Yongquan acupoints on both feet for a period of 4 hours to 12 hours during night time and 2 hours to 6 hours during night time hours during day time for 5 days to 45 days;

iv) delivering, by using two devices and via pubic bone and belly button, respectively, for a period of 4 hours to 12 hours during night time and 2 hours to 6 hours during day time for 5 days to 45 days;

v) delivering (a) by using four devices and via pubic bone, belly button, and both lungs for a period of 4 hours to 12 hours during day time, and (b) by using four devices and via pubic bone, belly button, and the Yongquan acupoints on both feet for a period of 4-12 hours during night time for 5 days to 45 days; and vi) delivering (a) by using four devices and via pubic bone, belly button, and both lungs for a period of 1 hour to 4 hours during day time, and (b) by using four devices and via pubic bone, belly button, and the Yongquan acupoints on both feet for a period of 4 hours to 12 hours during night time for 5 days to 45 days.

16. The method of claim 9, wherein an exogenous energy generated by the device and transmitted to the subject comprises one or more kinds of energy of the following:

i) the sound waves emitted from the speaker and transmitted into the human body via the energy pin;

ii) vibrations of the energy pin induced by the sound waves;

iii) sound waves reflected by the one or more energy rings;

iv) secondary energy waves emitted from the energy rings upon stimulation by the sound waves; and v) energy field of the energy rings, thereby harmonically and synergistically preventing, alleviating or treating COVID-19 (SARS-CoV-2) coronavirus infection in said subject.

17. The method of claim 9, wherein the subject has one or more conditions of the following: weakened immune system, neck pain and cervical spine disorder, low back pain and lumber spine disorder, knee pain, pain due to sports and/or injury, prostate diseases, gynecological diseases, hypertension, diabetes, cerebrovascular diseases, cardiovascular diseases, body stress and mental stress, dizziness, heart palpitations, tight chest, short breath, depression, chills, cold extremities, sadness, irritation and irritability, spontaneous sweating, coughs, asthma, insomnia and red-eyed insomnia, nightmares, inflammation and pain, leg pain, dark urine, low appetite, abdominal pains, flatulence, diarrhea, depression, nausea, vomiting, severe weight loss, abdominal distension, and fatigue.

* * * * *